US009101818B2

(12) United States Patent
Carr

(10) Patent No.: US 9,101,818 B2
(45) Date of Patent: Aug. 11, 2015

(54) MULTIFUNCTION SKI POLE

(71) Applicant: Alexander William Carr, Salt Lake City, UT (US)

(72) Inventor: Alexander William Carr, Salt Lake City, UT (US)

( * ) Notice: Subject to any disclaimer, the term of this patent is extended or adjusted under 35 U.S.C. 154(b) by 0 days.

(21) Appl. No.: 13/860,355

(22) Filed: Apr. 10, 2013

(65) Prior Publication Data

US 2013/0264809 A1 Oct. 10, 2013

Related U.S. Application Data

(60) Provisional application No. 61/622,412, filed on Apr. 10, 2012.

(51) Int. Cl.

| | |
|---|---|
| ***A45B 3/00*** | (2006.01) |
| ***A45B 9/02*** | (2006.01) |
| ***A63C 11/22*** | (2006.01) |
| ***B67B 7/16*** | (2006.01) |
| ***A63C 11/24*** | (2006.01) |
| ***B25B 15/02*** | (2006.01) |
| ***B25B 23/00*** | (2006.01) |
| ***B25F 1/02*** | (2006.01) |
| ***B25G 1/08*** | (2006.01) |

(52) U.S. Cl.

CPC ..... *A63C 11/222* (2013.01); *A63C 11/227* (2013.01); *A63C 11/24* (2013.01); *B25B 15/02* (2013.01); *B25B 23/0042* (2013.01); *B25F 1/02* (2013.01); *B25G 1/085* (2013.01); *B67B 7/16* (2013.01); *A63C 2203/06* (2013.01)

(58) Field of Classification Search

CPC .... A63C 11/22; A63C 11/222; A63C 11/228; A45B 9/02

USPC ..... 280/812, 813, 819, 821–824, 826; 135/65, 66, 76, 78; D03/5, 7, 12, 13

See application file for complete search history.

(56) References Cited

U.S. PATENT DOCUMENTS

| | | | | | |
|---|---|---|---|---|---|
| 1,961,099 | A | * | 5/1934 | Dickson | 280/821 |
| 3,232,632 | A | * | 2/1966 | Lewis | 280/822 |
| 3,545,784 | A | * | 12/1970 | Allsop | 280/821 |
| 3,561,782 | A | * | 2/1971 | Tyrack | 280/816 |
| 3,565,451 | A | * | 2/1971 | Giambazi et al. | 280/821 |
| 3,687,472 | A | * | 8/1972 | Struble, Jr. | 180/181 |
| 3,810,647 | A | * | 5/1974 | Martchenke | 280/816 |
| 3,825,276 | A | * | 7/1974 | Adelmann | 280/821 |
| 4,023,817 | A | * | 5/1977 | Lah et al. | 280/816 |
| 4,079,908 | A | * | 3/1978 | Davis | 248/156 |
| 4,364,585 | A | * | 12/1982 | Shields | 280/814 |
| 4,617,951 | A | * | 10/1986 | Adams et al. | 135/66 |
| 5,271,640 | A | * | 12/1993 | Potochick et al. | 280/816 |
| 5,359,797 | A | * | 11/1994 | Williamson | 280/816 |
| 5,788,608 | A | * | 8/1998 | Wilkinson | 482/51 |
| 6,032,332 | A | * | 3/2000 | Lin | 16/111.1 |
| 7,201,401 | B1 | * | 4/2007 | Friedman | 280/823 |
| 7,344,320 | B2 | * | 3/2008 | Barker et al. | 396/419 |
| D590,867 | S | * | 4/2009 | Schenone et al. | D16/242 |

(Continued)

*Primary Examiner* — J. Allen Shriver, II
*Assistant Examiner* — Travis Coolman
(74) *Attorney, Agent, or Firm* — Morriss O'Bryant Compagni, PC

(57) ABSTRACT

A ski pole comprises an elongate pole having a distal end and a proximal end. A grip is attached to the proximal end of the pole and is configured for grasping by a user. The grip has a proximal end and a distal end and defines a longitudinally extending bore therein between configured for receiving the proximal end of the pole in a distal end of the grip. A tool assembly is releasably coupled to the proximal end of the grip and is housed within the grip.

23 Claims, 25 Drawing Sheets

(56) References Cited

U.S. PATENT DOCUMENTS

| | | | | |
|---|---|---|---|---|
| 7,992,258 | B1 * | 8/2011 | Stitser | 16/430 |
| 7,996,961 | B2 * | 8/2011 | Blauer et al. | 16/431 |
| 8,210,570 | B1 * | 7/2012 | Nagle | 280/821 |
| 8,726,439 | B2 * | 5/2014 | Orzeck et al. | 7/118 |
| 2006/0163865 | A1 * | 7/2006 | Smith et al. | 280/821 |
| 2010/0072331 | A1 * | 3/2010 | Barton et al. | 248/176.1 |
| 2011/0049857 | A1 * | 3/2011 | Garcia | 280/816 |

* cited by examiner

MULTIFUNCTION SKI POLE

CROSS-REFERENCE TO RELATED APPLICATION

The present application claims priority to U.S. Provisional Patent Application Ser. No. 61/622,412 to Alexander William Carr filed on Apr. 10, 2012, the entirety of which is incorporated by this reference.

BACKGROUND OF THE INVENTION

1. Field of the Invention

The present invention relates generally to ski poles, and more specifically, to ski poles that have other built-in functionality by providing various tools for the user.

2. The State of the Art

A typical ski pole is comprised of an elongate hollow pole that includes a grip at one end and a ferrule (metal tip) that forms a tip at the other end. The pole may be comprised of aluminum or lightweight composite materials. Skiers use ski poles to improve balance as well as for propulsion. Aluminum poles are still one of the main types of ski pole on the market.

In a modern skiing one pole, near the tip end of the shaft, there is a circular "basket" attached to prevent the pole from penetrating too far into the snow. Baskets are typically comprised of plastic. Baskets can be relatively small and cone-shaped as used in racing or larger disk-shaped objects for use in powder or other more recreational skiing conditions. Attached to the upper part of the pole is a grip with a strap, either fastened to the pole or detachable. The straps can be slipped over the wrist of the skier to prevent the loss of the pole in the event of a fall.

Because recreational skiers almost always use ski poles, whether they be alpine or downhill skiers or Nordic or cross-country skiers, the ski pole is a skiing accessory that is nearly always carried by a skier. As such, it would be advantageous to utilize a ski pole to provide the skier with various tools that may be needed while skiing.

SUMMARY OF THE INVENTION

Accordingly, a ski pole is provided that is comprised of an elongate tubular pole having a grip end and a tip end. A grip is attached to the distal end of the ski pole. The grip, or a portion thereof, is removable from the ski pole to allow removal of a tool from inside the ski pole. The tool may comprise a flat head or Phillips screwdriver, a hex key, or other screwdriver types, such as those having a Robertson or square head, a Torx or star head, or other screwdriver types known in the art. In particular, the particular tools provided in the grip end of the ski pole are selected from those that can be used on the ski equipment of the skier, such as those needed to adjust the ski bindings of the skier or, in some cases the boots of the skier as well as other equipment, such as glasses, helmets, snowboard components and the like.

In another embodiment, the ski pole includes a basket that is provided with a bottle opener. The bottle opener may be comprised of a generally oval metal ring that is embedded in the plastic forming the basket. Conversely, the basket may be comprised of a metal skeleton that includes a bottle opener with the metal skeleton being surrounded by plastic that forms the basket. In either case, the skier can flip the ski pole over to access the bottle opener in order to open a bottle or simply be removed from the ski pole and used as a bottle opener.

DETAILED DESCRIPTION OF THE ILLUSTRATED EMBODIMENTS

Figure 1:
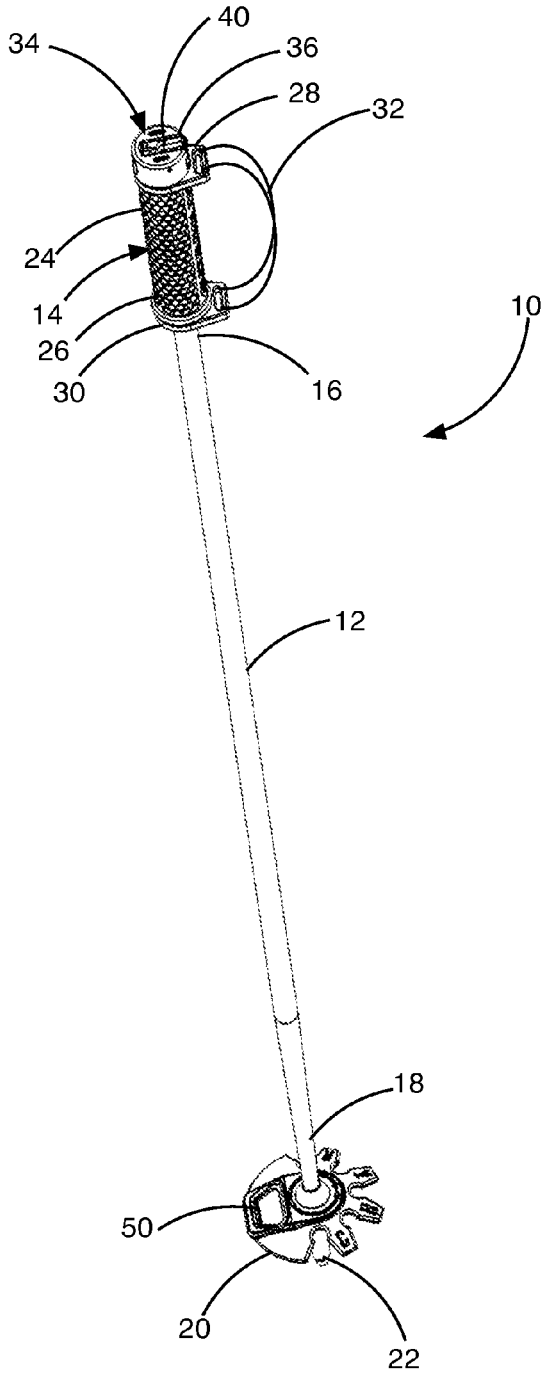
FIG. 1 is a perspective side view of a ski pole in accordance with the principles of the present invention.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112, 116. Thus, the use of the words "function," "means" or "step" in the Detailed Description of the Invention or claims is not intended to somehow indicate a desire to invoke the special provisions of 35 U.S.C. §112, 116, to define the invention. To the contrary, if the provisions of 35 U.S.C. §112, 116 are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. §112, 116. Moreover, even if the provisions of 35 U.S.C. §112, 116 are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. It should be noted that there are many different and alternative configurations, devices and technologies to which the disclosed inventions may be applied. The full scope of the inventions is not limited to the examples that are described below.

FIG. 1 is a ski pole, generally indicated at 10, in accordance with the principles of the present invention. The ski pole is comprised of an elongate hollow pole 12 having a grip assembly 14 attached to an outside surface thereof proximate the proximal end 16 of the pole 12. The distal end 18 of the pole 12 is provided with a basket 20 and a tip 22 that are attached to the pole 12.

The grip assembly 14 includes a generally cylindrical, hollow body 24 configured for grasping with a hand of a user. The body 24 includes an outer texture 26 in the form of a plurality of raised bumps to add a gripping surface to the body 24. On opposite ends of the body are strap attachment members 28 and 30 that are coupled to the body 24. A strap 32 is coupled between the strap attachment members 28 and 30 so as to provide a means to secure the grip assembly 14 to the hand of the user.

A tool assembly 34 is removably attached to the proximal end of the body 24. The tool assembly 34 includes a head 36 that at least partially houses a camera mount 40. By removing the head 36 from the grip assembly 14, a tool, such as a screwdriver attached to the head 36 can be removed from the pole 12. When the head 36 is coupled to the grip assembly 14, the ski pole 10 can be used as a monopod to support a camera, for example.

At the distal end of the ski pole 10, the basket 20 is provided with a bottle opener 50. The bottle opener 50 is comprised of metal and is embedded in the basket 20. In use, the ski pole 10 can be flipped over to access the bottle opener 50 with the bottle opener being used to open a bottle (not shown).

Figure 2:
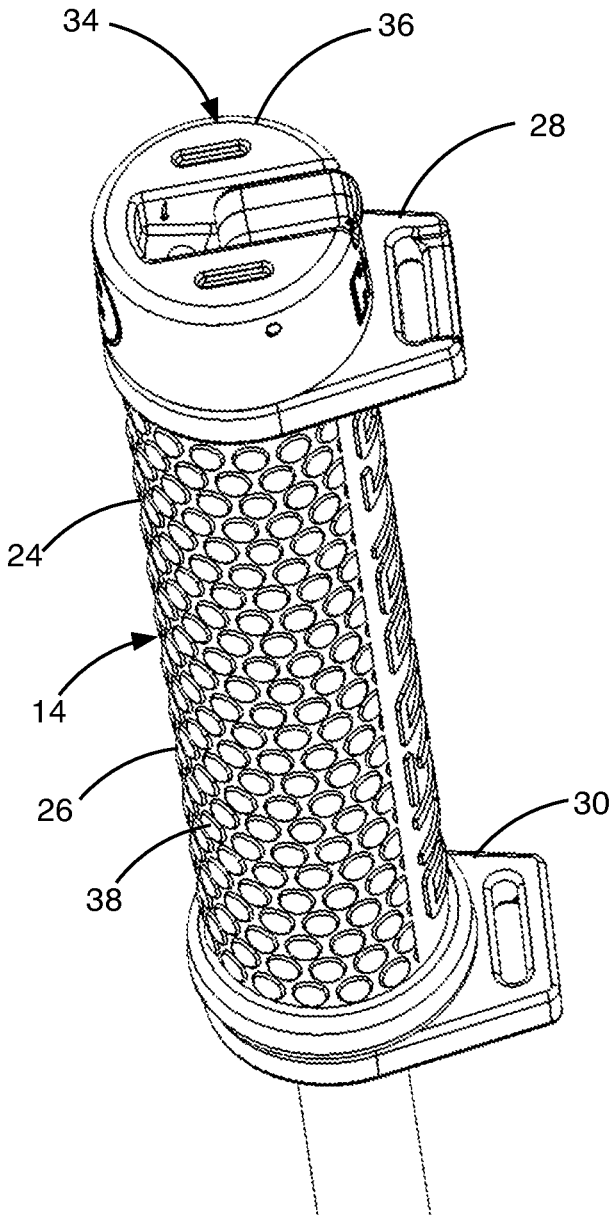
FIG. 2 is a perspective side view of the ski pole grip illustrated in FIG. 1.

As shown in more detail in FIG. 2, the head 36 of the tool assembly 34 holds the upper strap attachment member 28 to the body 24. The lower strap attachment member 30 may be held to the body 24 by a friction fit, snap fit or may be permanently attached to or integrally formed with the body. By allowing the upper and lower strap attachment members 28 and 30 to pivot or swivel relative to the body 24, the body 24 can be made substantially cylindrical, thus allowing the grip 14 to be used in any orientation by the user. As such, it may not be necessary to cause orientation of the attachment members 28 and 30 at a certain location relative to the body 24. The strap (see FIG. 1) can be utilized to orient the support members 28 and 30 relative to one another on the same side of the body 24. The outer surface of the body 24 may be texturized as with a plurality of bumps 38 as illustrated.

Figure 3:
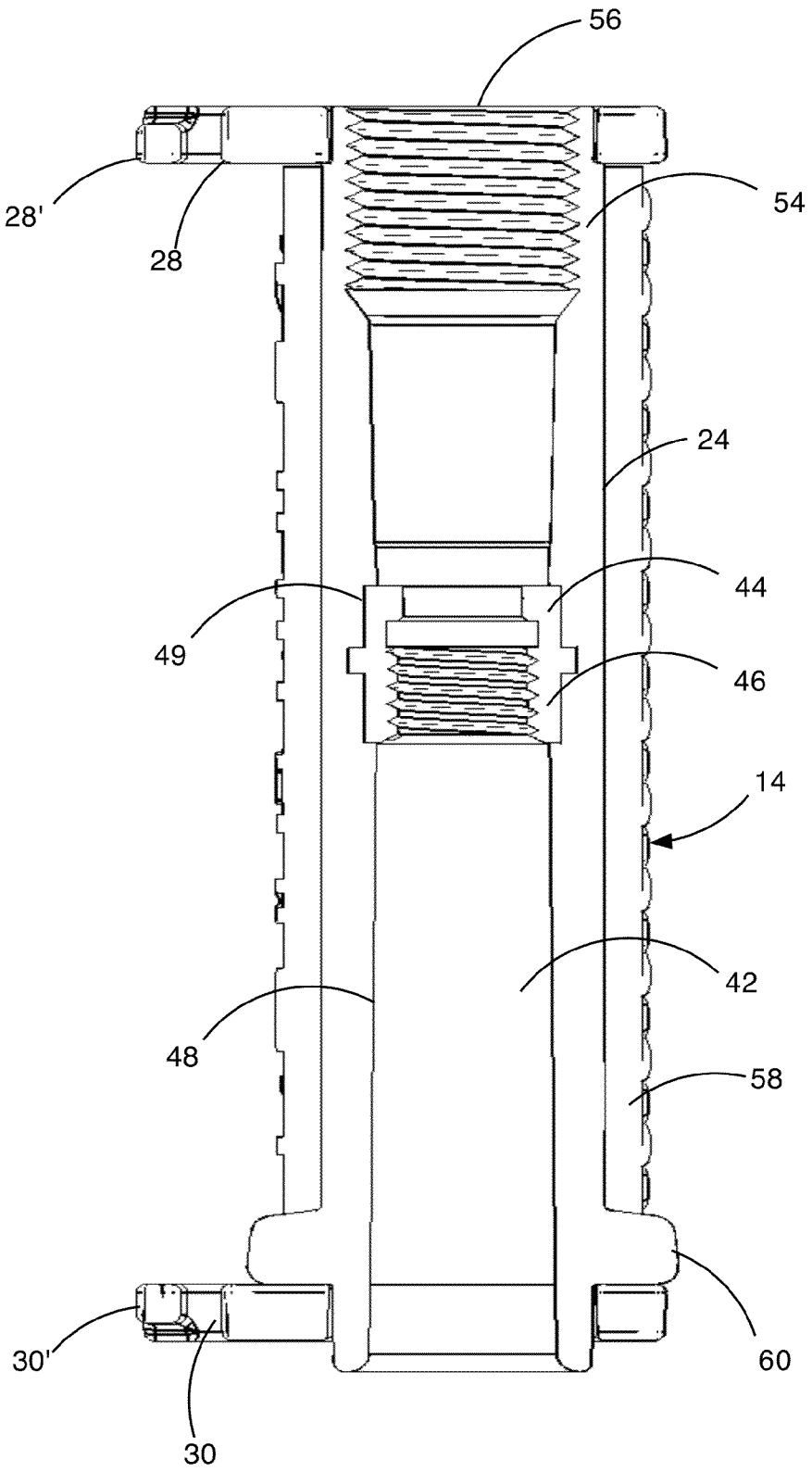
FIG. 3 is a cross-sectional side view of the ski pole grip illustrated in FIG. 2.

As further illustrated in FIG. 3, the grip 14 is comprised of the elongate hollow body 24 that defines a central channel 42 that runs the length of the body 24. Embedded within the body 24 is a receiving member 44. The receiving member 44 may be molded into the body 24 or otherwise securely attached. The receiving member 44 has a lower internally threaded end 46 configured for receiving a corresponding externally threaded end (not shown) of the pole 12 (see FIG. 1). The receiving member 44 is positioned high enough within the grip 14 so as to allow the upper end of the pole 12 to engage the inner side wall 48 of the body 24 so as to firmly engage with the upper end of the pole 12. The receiving member 44 may be comprised of metal so as to provide a strong connection between the top of the ski pole and the grip 14, whereas the body may be comprised of a molded plastic material, such as plastic materials known in the art for forming handles for ski poles. The upper end 49 of the receiving member 44 is also open so as to define a longitudinally extending aperture therethrough. This allows passage of any elongate tool, such as a screwdriver through the receiving member 44 and into the pole 12 as necessary. The upper end 54 of the body 24 is provided with internal threads 56 configured for receiving external threads on the tool 34 to secure the tool 34 to the grip 14. The upper and lower strap attachment members 28 and 30 are coupled to the body 24 and have strap retaining portions 28' and 30' that extend therefrom. The gripping surface 38 may comprise a rubberized wrap 58 that circumscribes the body 24 and is held in place between upper strap member 28 and a wider base portion 60 of the body 24.

Figure 4:
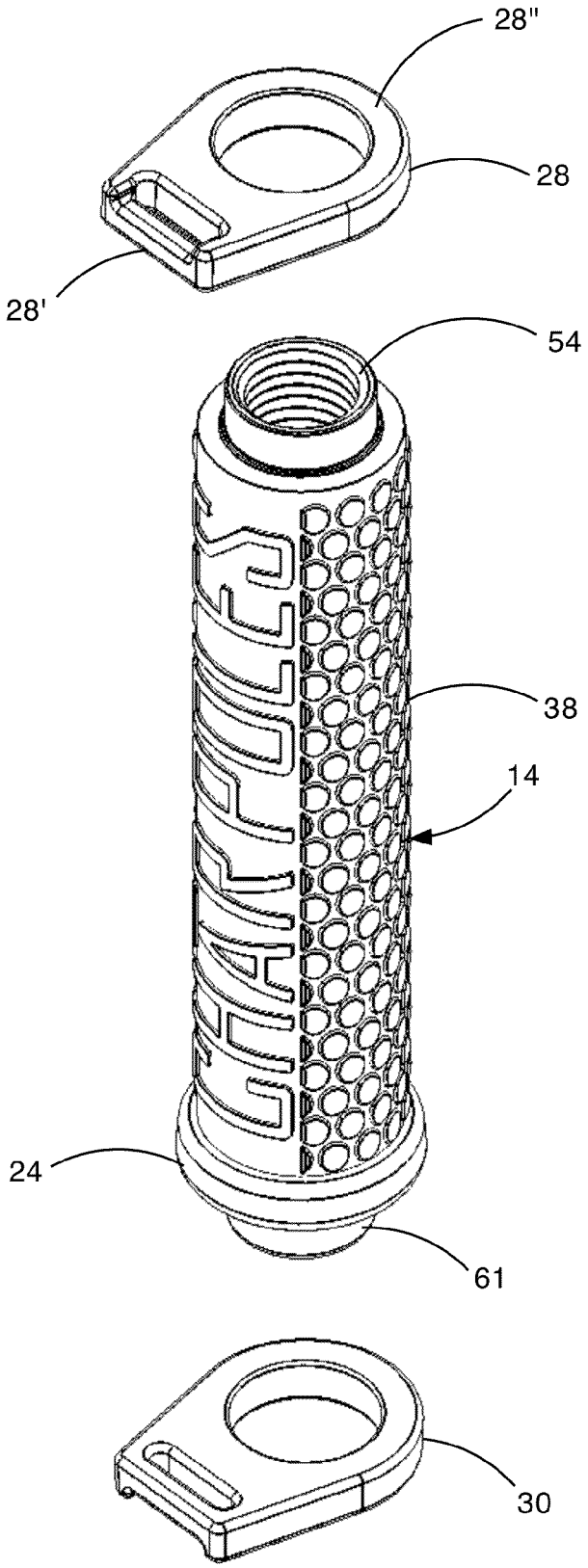
FIG. 4 is an exploded perspective side view of the ski pole grip illustrated in FIG. 2.

As further illustrated in FIG. 4, the grip 14 includes the body 24 having an upper internally threaded end 54 and an open lower end 61 for receiving the ski pole 12. A gripping surface 38 extends around the body 24 and is generally cylindrical in shape. The gripping surface 38 can be slid onto the body 24 during assembly prior to installation of the upper strap retaining member 28. As such, if the gripping surface 38 becomes worn from excessive use, removing the upper retaining member 28 by removing the tool 34 from the body 24 allows the gripping surface 38 to be slid from the body 24 and replaced with a new gripping surface if desired. As such, unlike conventional ski poles, the gripping surface 38 can be formed from a relatively soft rubber or rubber-like material that provides substantial tackiness that may also be susceptible to some wear during use. The gripping surface 38, once worn however, can be easily switched out. This also allows a user to simply customize the ski pole by switching out the gripping surface 38 with a gripping surface of another color, even when not worn.

Each of the upper and lower strap retaining members 28 and 30 are similarly configured. The retaining member 28 includes a ring-like portion 28" and a strap retaining potion 28' extending therefrom. Conventional ski pole straps attach to the upper end of the ski pole grip only with both ends of the strap attached at a single location. By providing upper and lower strap attachment members, the common problem of inserting a ski glove through a loop comprising the strap is eliminated. Instead, the user simply inserts their hand between the strap 32 (see FIG. 1) and the grip 14.

Figure 5:
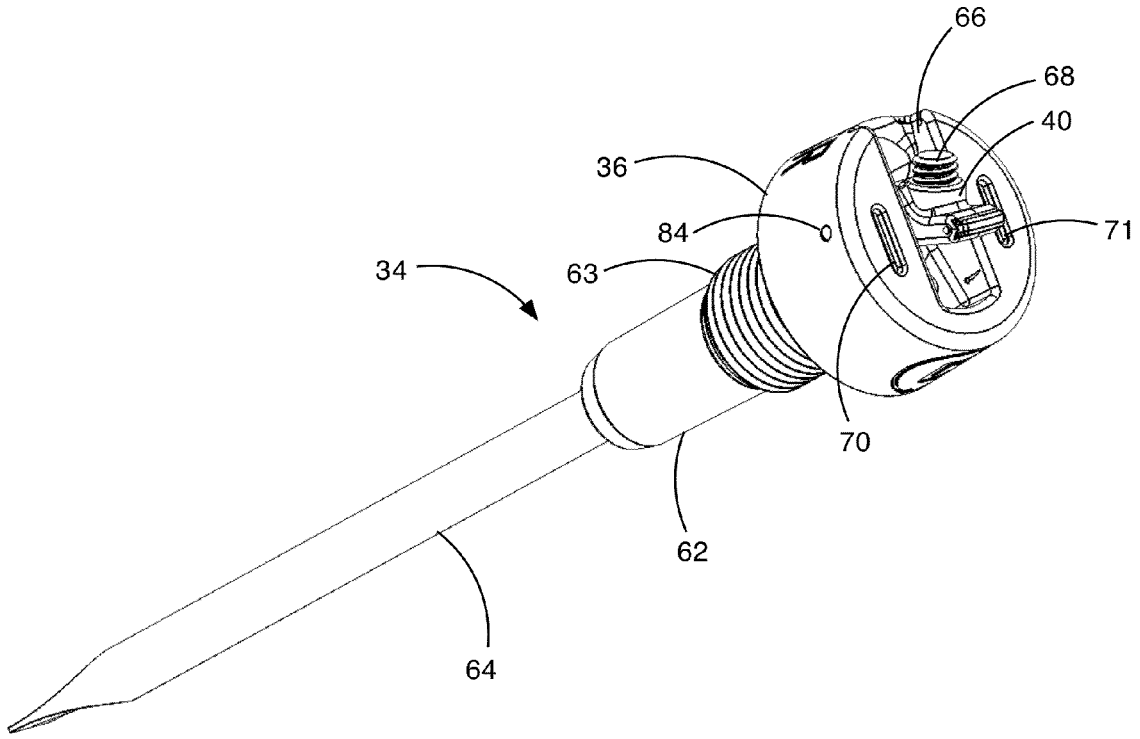
FIG. 5 is a perspective side view of a tool for the ski pole illustrated in FIG. 1 in accordance with the principles of the present invention.

Referring now to FIG. 5, there is illustrated one embodiment of the tool 34. The tool 34 comprises a head 36 a neck 62 and an elongate tool 64. As previously mentioned, the head holds the upper strap retaining member 28 to the grip 14 and is thus wider than the internal diameter of the ring portion 28" of the member 28. The neck 62 is integrally formed with the head 36 and extends therefrom. The upper end of the neck 62 includes threads 63 so as to engage with threads 56 in the body 24 of the grip 14 (see FIG. 3). The lower portion of the neck 62 extends from the threads 63 and provides the attachment structure to attach the tool 64 to the head 36. The head 36 further includes a pivotable camera mount 40. The head 36 defines a recess 66 configured for allowing the camera mount 40 to pivot from a first position in which a threaded camera mount post 68 is exposed to a second position in which the threaded camera mount post 66 is positioned within the head 36. In the first position, a camera, such as a GO PRO digital video camera, can be mounted to the head 36. When the tool 34 is attached to the grip 14 of the ski pole 10 the ski pole can be planted into the snow with the ski pole 10 functioning as a monopod. In order to prevent the camera mount 40 from being exposed and potentially causing damage to objects that may be stricken by the head 36, the camera mount can be pivoted or flipped to a closed position in which the post 68 of the camera mount 40 is not exposed.

As will be discussed in more detail, in order for the user to determine which tool is contained within the ski pole 10 without having to remove the tool 34, recessed indicator markings 70 and 71 are molded into the top surface of the head 36, in this example indicating a flat head screwdriver.

Figure 6:
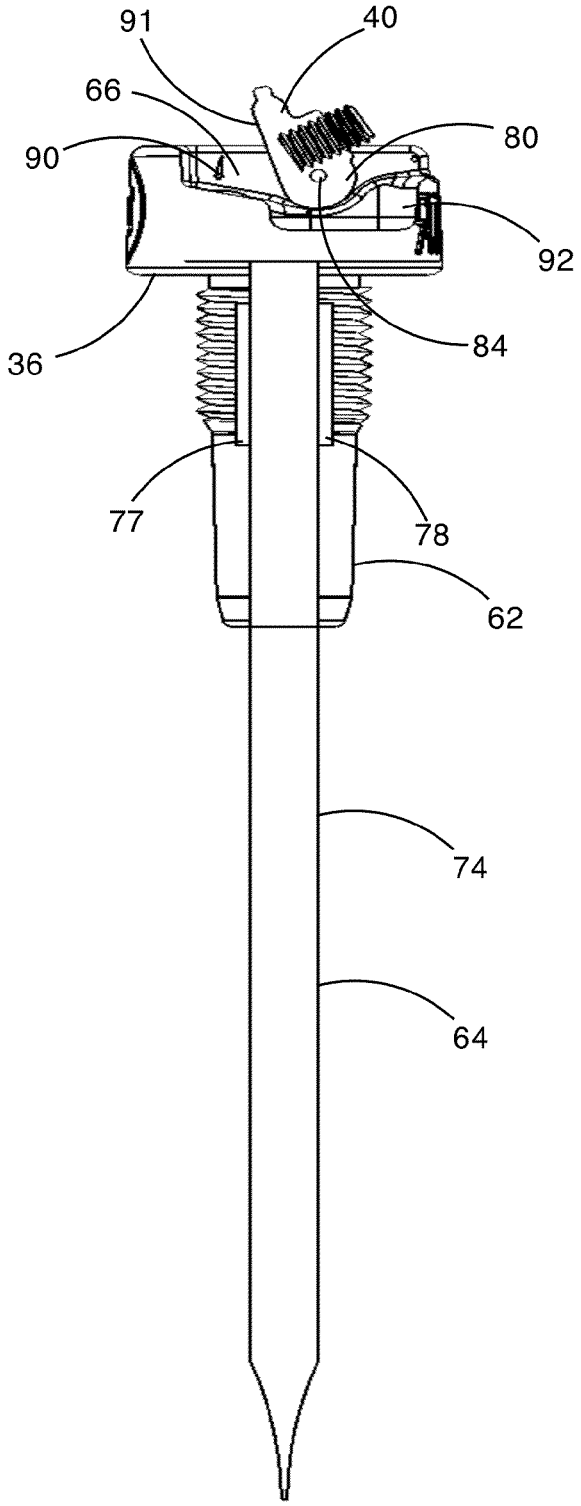
FIG. 6 is a cross-sectional side view of the tool illustrated in FIG. 5.

As shown in FIG. 6, the metal shaft 74 defining the screwdriver tool 64 is retained within the neck 62 by being molded therein when the head 36 and neck 62 are formed. The shaft 74 includes laterally extending fin portions 77 and 78 that prevent rotation of the shaft 74 relative to the neck 62 when the head 36 is grasped and the screwdriver tool 64 is used to tighten or loosen a screw (not shown). The fins 77 and 78 also prevent the tool 64 from being pulled from the head 36 during use. As such, the tool 74 is fixedly attached to the neck 62 and thus the head 36. It is also contemplated however, that the neck 62 could removably house the tool 64 so that the tool can be removed and replaced with another tool or removed, rotated 180 degrees and reinserted into the neck 62 where the tool 74 has a head of a different configuration on the opposite end of the shaft 74. Thus, for example, the shaft 74 could include a flat head screwdriver on one end and a Phillips head screwdriver on the opposite end. In such a case, the indicators 70 and 71 on the head 36 would include an indicator 70 for a flat head screwdriver and an indicator, in the form of a cross, for a Phillips screwdriver. Thus, each tool 64 may include two tools.

Figure 7:
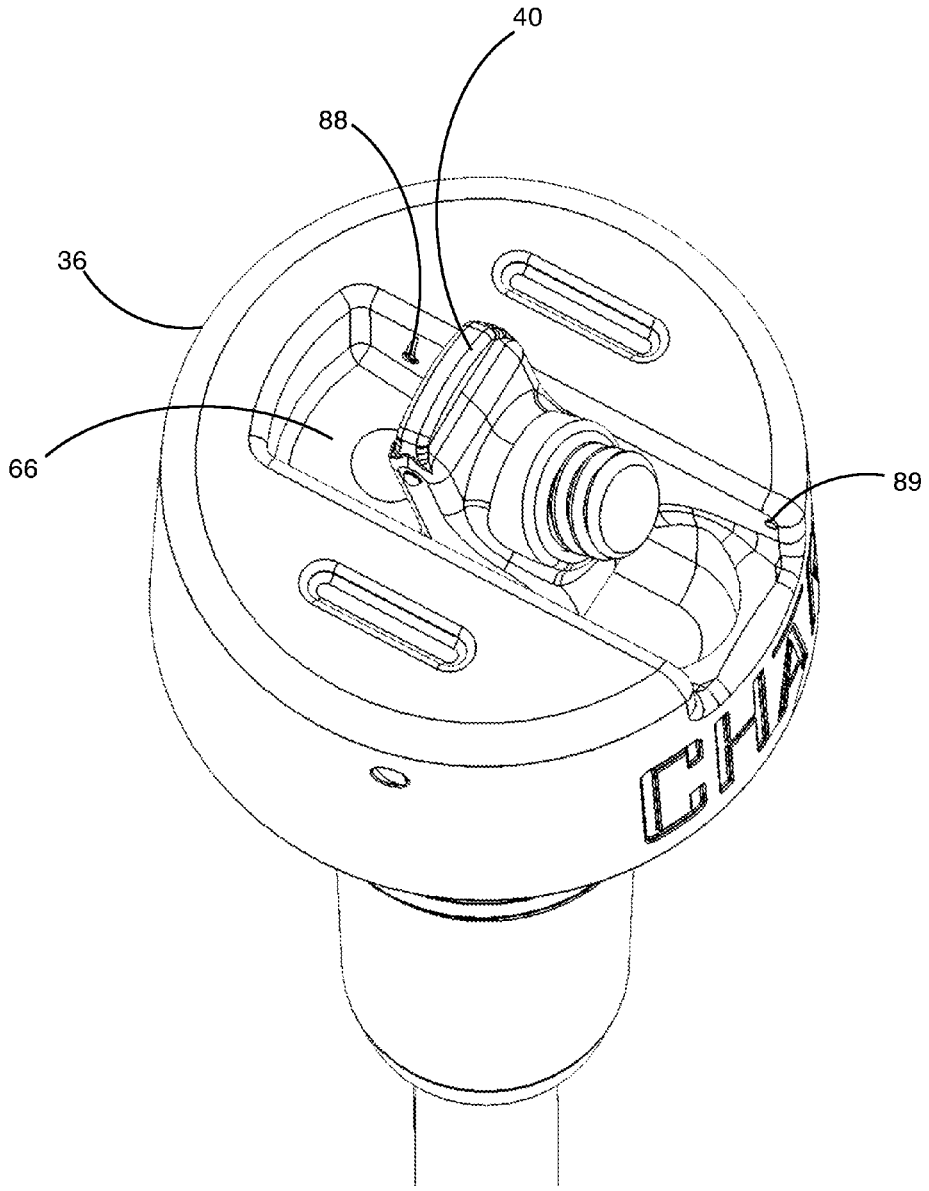
FIG. 7 is a perspective top side view of the tool illustrated in FIG. 5.
Figure 8:
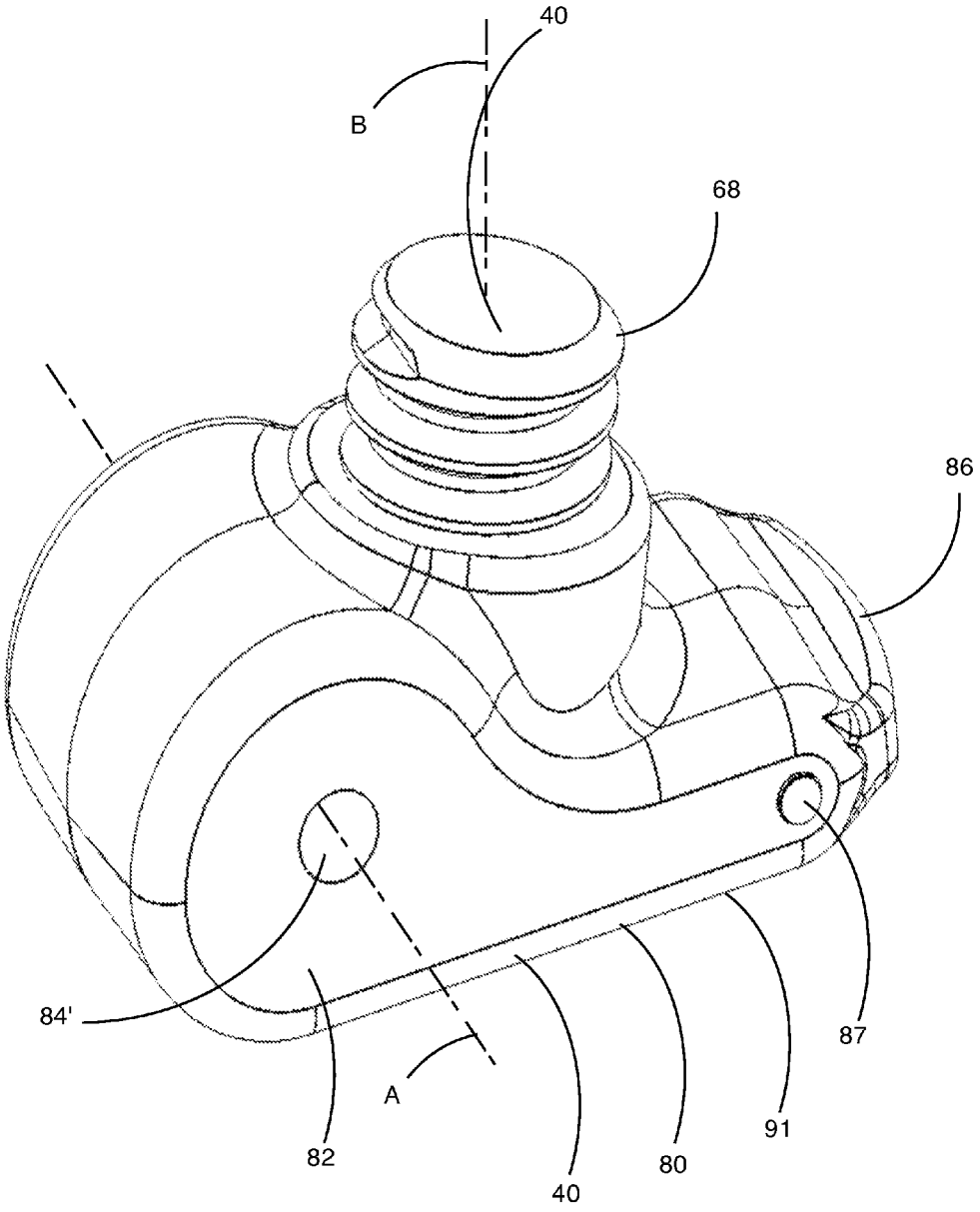
FIG. 8 is a perspective side view of a camera mount for the tool illustrated in FIG. 7.

Referring to FIGS. 6, 7 and 8, the camera mount 40 fits at least partially within the recess 66 in the head 36. The camera mount 40 includes a "d" shaped body 80 comprising a pivotable portion 82 configured for mounting within the head 36 and pivoting upon a laterally extending pin 84 through axis A. The axis A is offset from and perpendicular to the longitudinal axis B of the mounting post 68. This allows the post 68 to pivot from the first position that is near a long axis of the ski pole to a second position that is nearer a perimeter edge of the head 36. The end 86 of the camera mount 40 is spaced from the axis a so as to be proximate the perimeter of the head 36 when in the closed position with the post 68 in an unexposed position. The end 86 of the camera mount is configured to be graspable by a user to allow the user to flip over the camera mount 40 as it is pivoted about the axis A. The pin 84 engage with and extends through the head 36 and through aperture 84' in the body 80 so that the mount 40 pivots about the pin 84. Protrusions 87 are formed on the outside of the body 80 near the end 86 and engage with recesses 88 formed on the inside of the recess 66 when the body 88 is pivoted to an open position and engage with recesses 89 when the body 80 is pivoted to a closed position. As such, the engagement of the body 80 is fully pivoted one direction or the other, the body engages with the head 36 to hold the body 80 in place. The recess 66 includes a first surface 90 for abutting the top surface 91 of the body 80 when in the first position, a lower recess portion 92 for receiving the pivotable portion 82 of the body 80 that is lower than the first surface 90 and includes a camera post receiving portion. As such, when the body 80 is pivoted closed, the camera post 68 is housed within the head 36 and the end 86 is exposed so as to be graspable by a user to rotate the body 80 open.

Figure 9:
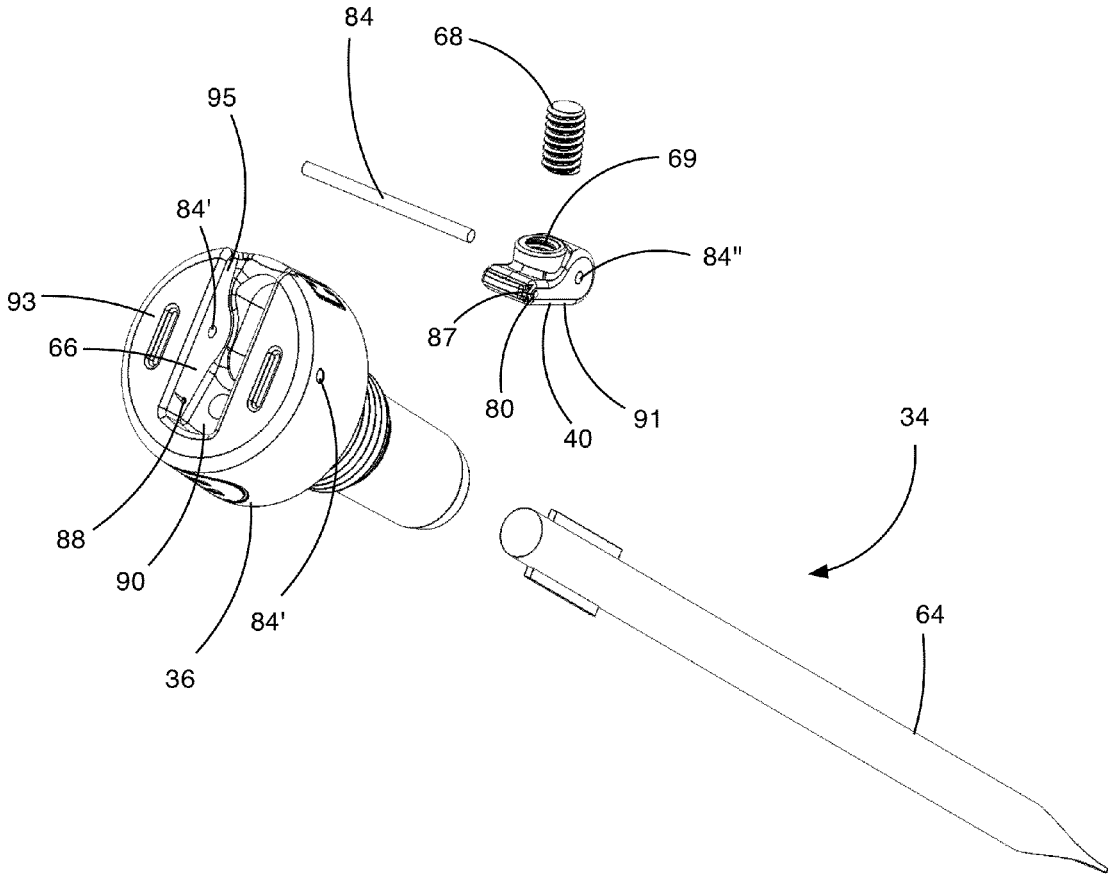
FIG. 9 is an exploded perspective side view of the tool illustrated in FIG. 5.

As shown in FIG. 9, which is an exploded view of the tool assembly 34, the body 80 of the camera mount 40 is pivotally coupled to the head 36 with an elongate pin 84 formed from metal, such as stainless steel to prevent corrosion in wet environments. A camera mount post 68 is threadedly coupled to the body 80 by being received in post bore 69. The "d" or "b" shaped camera mount body 80 includes a transversely extending bore 84" for receiving the pin 84 and is pivotally coupled to the head 36 by passing the pin 84 through apertures 84' formed in the head 36. The mount body 80 is substantially housed within the recess 66 formed in the top of the head 36 when in a closed position so that the surface 91 is substantially flush with an upper surface 93 of the head 36 and the post 68 is positioned within the recess 66 of the head 36. The protrusions 87 on both sides of the body 80 engage with recesses 95 to hold the body 80 in the closed position. In an open position, the body 80 is pivoted approximately 180 degrees so that the surface 91 is positioned within the recess 66 as by abutting against surface 90 and the protrusions 87 engage recesses 88. In this position, the post 68 is oriented with a long axis thereof in substantial alignment and substantially parallel to the long axis of the tool 64. As such, the post 68 will upwardly extend from the head and thus the ski pole 10 of the present invention when in the open position to provide a camera mount at the top or proximal end of the ski pole 10 (see FIG. 1).

Figure 10:
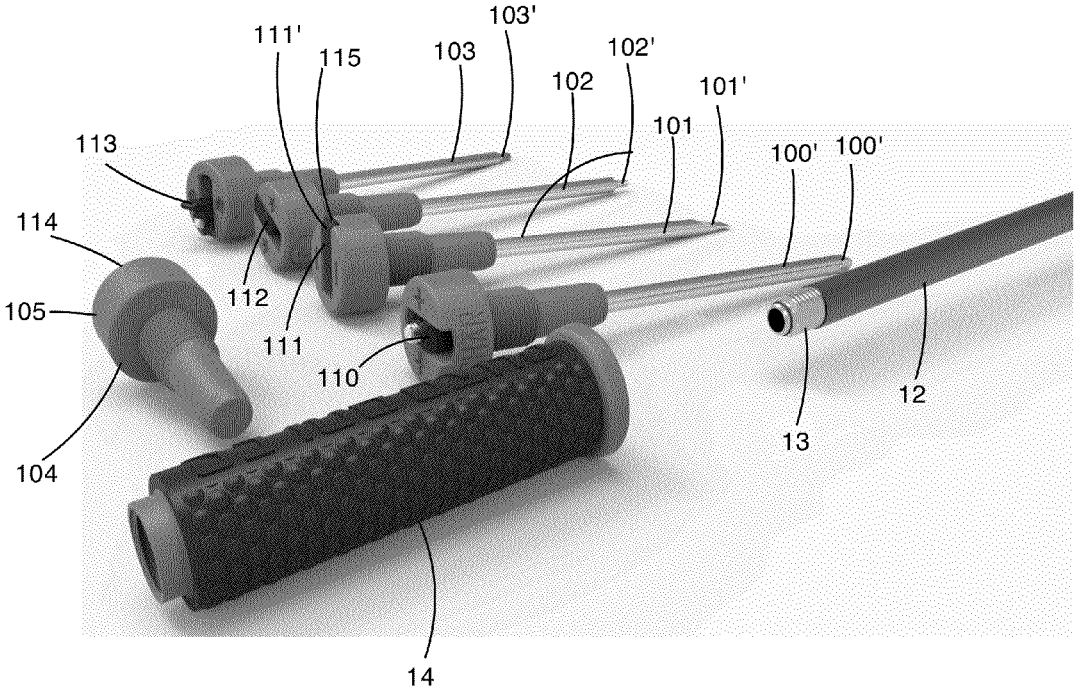
FIG. 10 is a perspective side view of a plurality of tools for the ski pole illustrated in FIG. 1 in accordance with the principles of the present invention.

As illustrated in FIG. 10, a plurality of tools assemblies 100-103 may be provided with the ski pole 12 and grip 14. Each tool assembly 100-103 has a different tool end 100'-103'. In use, since two ski poles are typically used by each skier, two desired tools can be carried the skier, one in each ski pole. In the event that the skier does not want to carry any tool, the head 105 of the blank tool assembly 104 may be a blank head with no tool attached thereto, which to some extent decreases the weight of the ski pole. Each head of each of the tool assemblies 100-104 includes a camera mount 110-114. The camera mount 110 is shown in an open position, the camera mounts 111 and 112 are shown in a closed position and the camera mount 113 is shown in a partially open position. As shown with reference to camera mount 111, the exposed end of the body 111' includes a tab 115 that extends slightly beyond a perimeter of the head for grasping by a user to flip or pivot the camera mount 111 from the closed position as shown to an open position. The ski pole 12 has a threaded proximal end 13 for threadingly engaging with the grip 14 as previously described.

Figure 11:
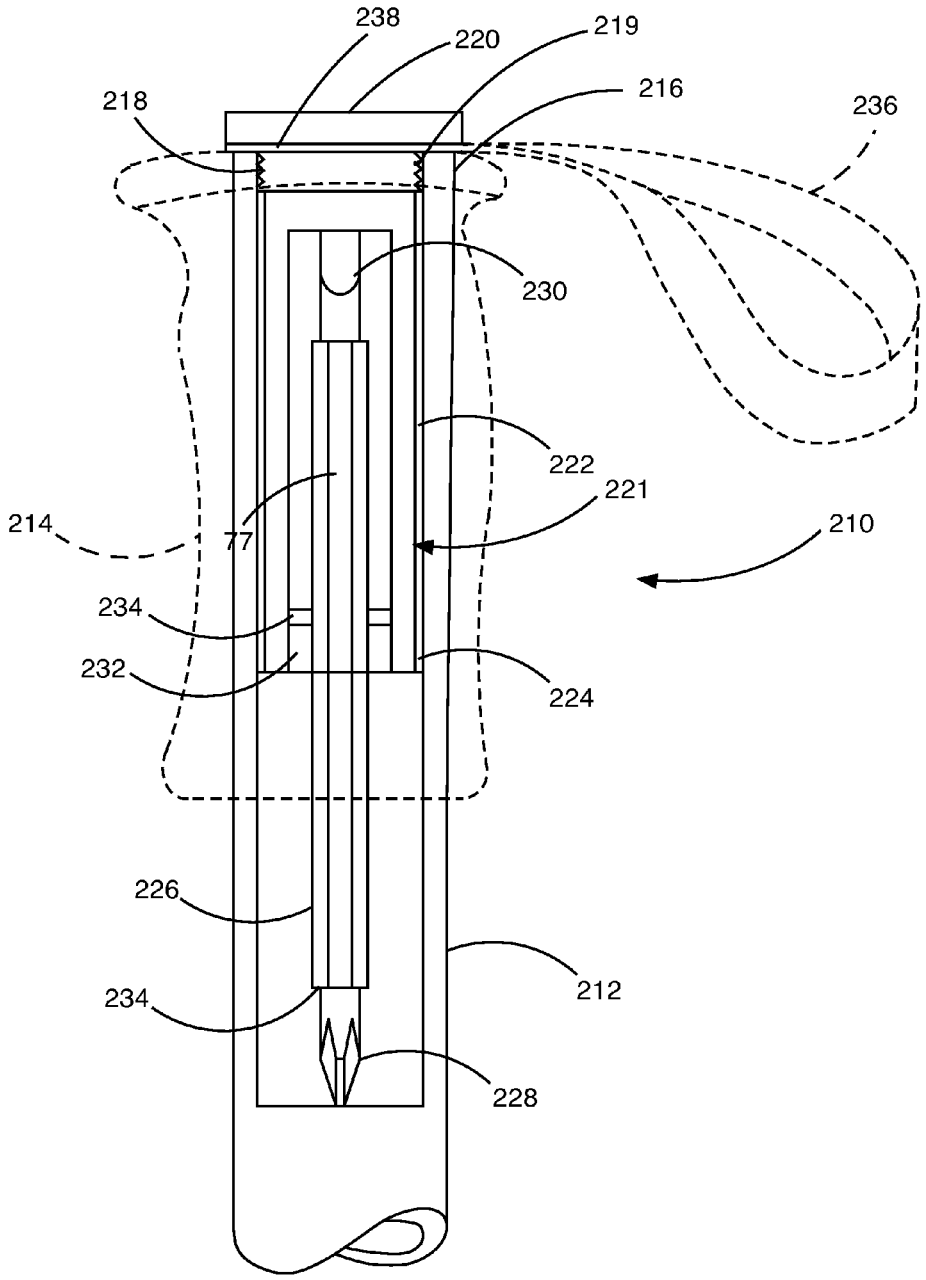
FIG. 11 is a cross-sectional side view of another embodiment of a grip for a ski pole in accordance with the principles of the present invention.

FIG. 11 is a partial cross-sectional side view of an upper or grip portion of a ski pole, generally indicated at 210, in accordance with the principles of the present invention. The ski pole is comprised of an elongate hollow pole 212 having a grip 214 attached to an outside surface thereof proximate the proximal end 216 of the pole 212. The distal end 16 of the pole 212 is provided with internal threads 218 for engaging with external threads 219 on an end cap 220. The end cap 220 is coupled to a screwdriver grip handle 222 that is sized to fit within the central bore or chamber 224 of the pole 212. A dual headed screwdriver bit 226 is releasably coupled to the handle 222. The bit 226 includes, by way of example, a Phillips head screwdriver 228 at one end and a flat head screwdriver 230 at the opposite end. The bit 226 is retained within the handle 222 with a hex shaped retaining ring 232 and biasing ring 234 that holds the bit 226 within the handle 222 until physically removed by the user by pulling the bit 226 from the handle 222. In this way, the bit 226 will remain in place until removed by the user to allow the user to remove, reverse and reinsert the bit 226 into the handle 222 for using the desired bit end. An abutment surface 234 may also be provided within the pole 222 to hold the bit 226 relative to the handle 222 when inserted into the pole 212.

The end cap 220 also retains a wrist strap 236 relative to the proximal end 216. A retaining ring 238 is held between the end cap 220 and the proximal end 216 of the pole 212. The retaining ring 238 is coupled to the wrist strap 232 to hold the wrist strap 236 relative to the pole at the top end of the grip 214.

To access the screwdriver 221, the user can unscrew the end cap 220 and pull the screwdriver 221 out from the pole 212. The retaining ring 238 may be attached to the end cap so that the wrist strap can be placed over the skier's wrist while using the screwdriver 221 so as to prevent loss of the screwdriver if accidentally dropped. That is, because of the depth of snow where skiing occurs, dropping the screwdriver in deep powder will most certainly result in a loss of the screwdriver. By making the screwdriver removal possible without having to remove the wrist strap from the user, as is possible by making the retaining ring 238 rotatably attached to the end cap 220, the user can remove the end cap 220 and screwdriver 221 without fear of dropping the screwdriver. Each of the two ski poles used by a skier can be provided with screwdrivers with different types of bits provided in each ski pole to provide the skier with various tools while skiing.

Figure 12:
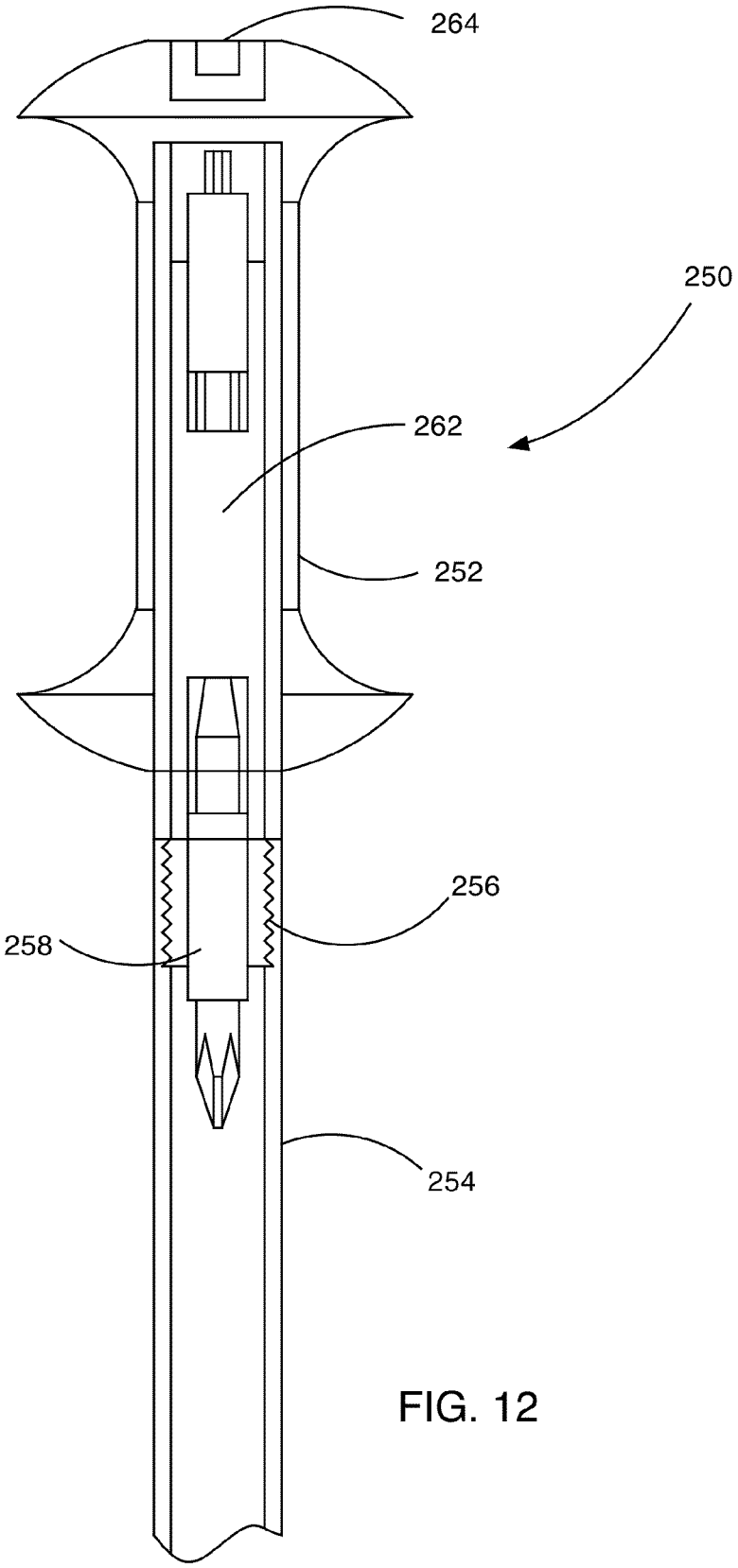
FIG. 12 is a cross-sectional side view of yet another embodiment of a grip for a ski pole in accordance with the principles of the present invention.

FIG. 12 illustrates an alternative embodiment of a multi-function ski pole, generally indicated at 250, in accordance with the principles of the present invention. The ski pole 250 includes a grip handle 252 attached to a proximal end of an elongate hollow tube or pole member 254. The handle 252 is removably attached to the pole member 254 as with threaded portion 256 that threadedly engages with an internally threaded portion at the proximal end of the pole member 254. Once removed, the handle 252 becomes a screwdriver handle to which screwdriver bit members 258 and 260 are removably attached. The screwdriver bit members 258 and 260 are removably attached to the handle 252 via a removable bit retaining member 262 in which the bit retaining member can be removed from the handle by pulling to allow the bit retaining member 262 to be reversed and reinserted into the handle 252 to allow use of the bit member 260. Each bit member 258 and 260 is also selectively removable and reversible relative to the bit retaining member 262 so that each bit 258 and 260 provides two different styles or sizes of screwdriver bit. For example, the bit 258 provides a Phillips head screwdriver at one end and a flat head screwdriver at the opposite end. The bit 260 includes a hex wrench screwdriver of a first size at one end and a hex wrench screwdriver of a second size at the opposite end thereof. Each bit 258 and 260 is held relative to the bit retaining member by friction fit or may be provided with a spring loaded ball bearing attachment means, such as that commonly provided on socket wrenches known in the art. Similar engagement of the bit retaining member 262 to the interior of the handle 252 is also provided to maintain the bit retaining member 262 within the handle 252 during use and while skiing, but still allow the user to remove the bit retaining member to access the bit 260.

The proximal end of the handle 252 includes a threaded aperture 264 therein for receiving a camera or other similar mount that will allow attachment of a camera to the handle 252. In such situations, the ski pole 250 can act as a monopod for stabilizing a video or still camera.

Figure 13:
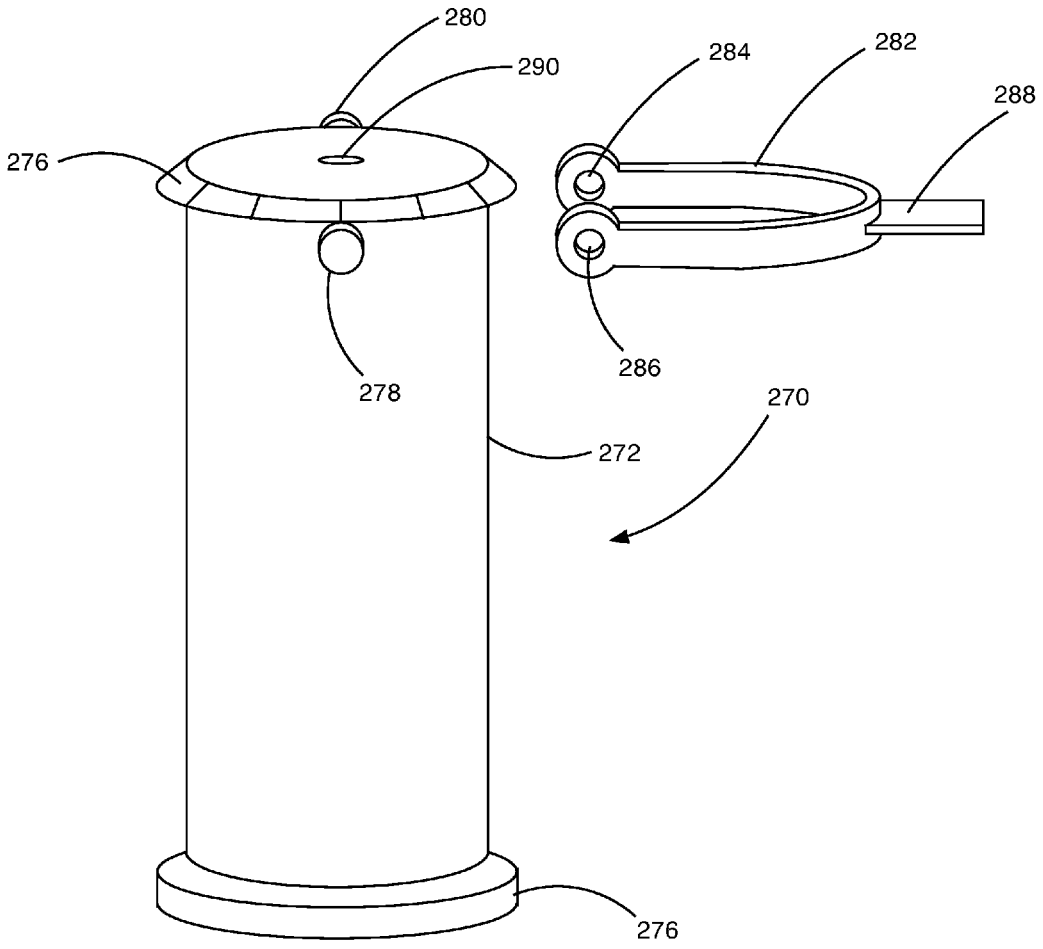
FIG. 13 is a perspective side view of still another embodiment of a grip for a ski pole in accordance with the principles of the present invention.

Other embodiments of a grip handle configuration are also contemplated in accordance with the present invention. For example, as shown in FIG. 13, a handle 270 is comprised of a generally cylindrical member 272 having disk-shaped enlarged radial portions 274 and 276 at each end thereof. The radial portions 274 and 276 prevent a skier's hand from slipping off of the handle 270 when grasped. A pair of laterally extending strap retaining members 278 and 280 are provided proximate the upper radial portion 274 for attachment of a wrist strap 282. The strap retaining members 278 and 280 are comprised of small disks or beads that are supported by a stem having a smaller diameter than the disks or beads to space the disks or beads from the handle 270. The strap 282 includes a pair of apertures 284 and 286 to be fitted over the retaining members 278 and 280 to secure the strap 282 to the handle 270. The strap can be formed from a resilient plastic or rubber material so as to allow the apertures 284 and 286 to be expanded while fitting over the retaining members 278 and 280, but that return to a size that is smaller than the retaining members to as to prevent the strap from being easily removed from the handle 270. The strap 282 also includes an integrally attached tab 288 extending therefrom for attachment or integration of a company logo or for attachment to a tag having a company logo thereon. Similar to the handle 252 shown in FIG. 11, the grip handle 270 of the FIG. 13 is provided with an internally threaded bore 290 at the top end thereof for attachment of a camera or other device.

Figure 14:
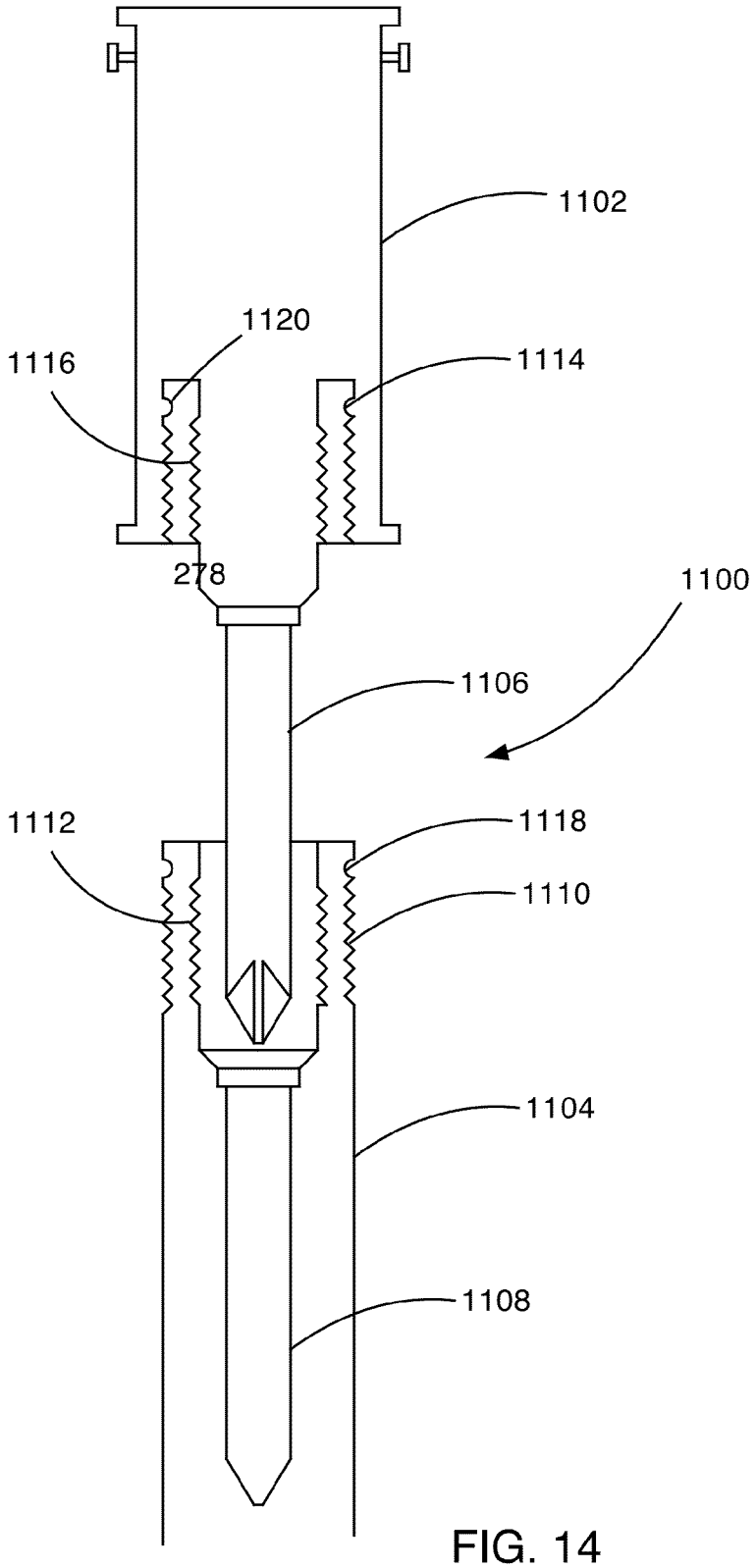
FIG. 14 is a perspective side view of another embodiment of a grip for a ski pole in accordance with the principles of the present invention.

FIG. 14 illustrates yet another embodiment of a combination ski pole and removable grip with hand tool in accordance with the principles of the present invention. The ski pole 1100 is comprised of a grip portion 1102 and a pole portion 1104. The grip portion is configured similarly to the grip 270 shown in FIG. 13 and includes a screwdriver 1106 extending downwardly therefrom. The pole portion 1104 includes a receptacle 1108 for receiving the screwdriver 1106 when the screwdriver 1106 is inserted into the pole 1104. The proximal end of the pole portion 1104 is provided with external and internal threads 1110 and 1112, respectively, for engaging with threads 1114 and 1116 provided in the grip portion 1102. The internal and external threads provide a secure engagement between the grip portion 1102 and the pole portion 1104 to prevent separation by the two while skiing. In addition, the upper portion of the external threads 1110 are provided with a circumferential recess 1118 for engaging with internal protrusion 1120 located above the threads 1114 that causes the threaded portion of the pole 1104 to lock relative to the grip 1102 so as to further prevent inadvertent loosening or separation of the grip 1102 from the pole 1104 until the skier forces, by twisting the grip relative to the pole, the pole 1104 to separate from the grip 1102 to access the screwdriver 1106.

Figure 15:
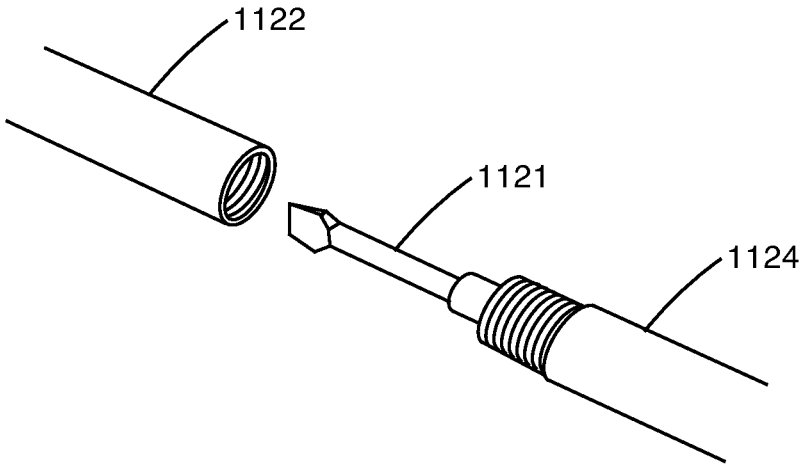
FIG. 15 is a perspective side view of another embodiment of a tool for a ski pole in accordance with the principles of the present invention.

As shown in FIG. 15, it is further contemplated that a hand tool 1121, such as a screwdriver, could be provided within the pole 1122 itself by being coupled to another pole part 1124. The pole 1122 may be provided with internal threads for receiving and engaging with external threads on the pole part 1124.

Figure 16:
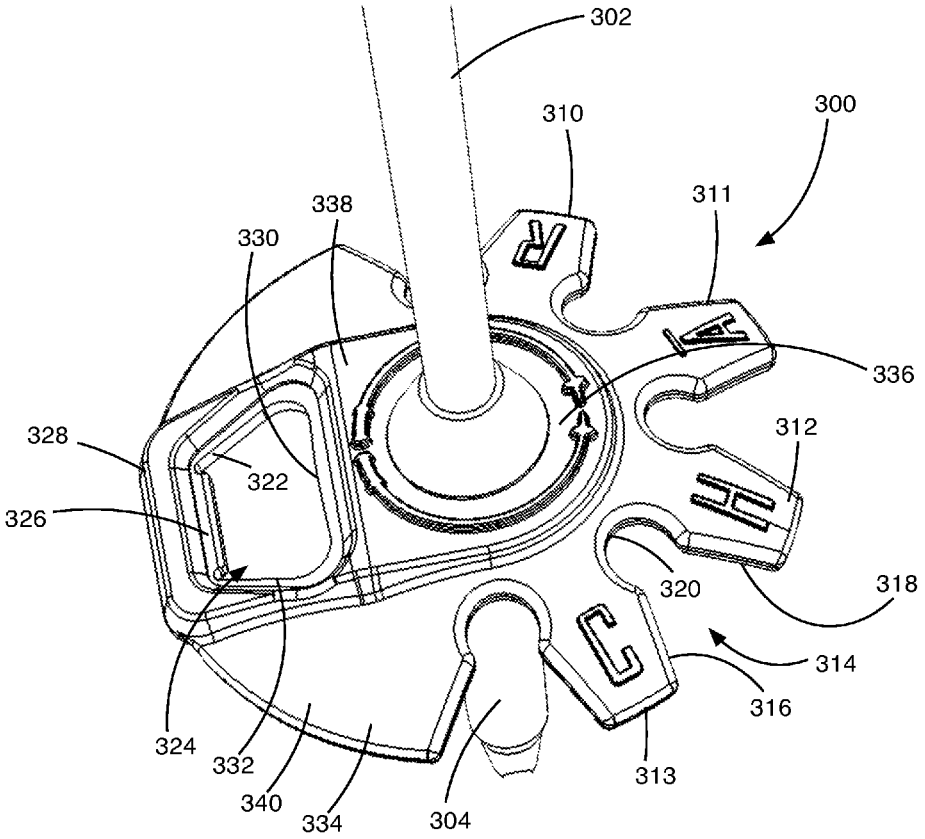
FIG. 16 is a perspective top side view of a ski pole basket for a ski pole in accordance with the principles of the present invention.

Referring now to FIG. 16, there is illustrated a first embodiment of a basket, generally indicated at 300, in accordance with the principles of the present invention. The basket 300 is removably attached to a ski pole 302 with a tip 304 that is attached to the distal end of the ski pole 302. As will be described in more detail, the tip 304 includes an upper threaded portion with a central aperture of the basket 300 having corresponding internal threads for mating with the tip 304 to secure the basket 300 to the tip 304. It is contemplated, however, that the basket 300 may include various other attachment features so as to be attachable to any number of existing ski poles and ski pole tips.

The basket 300 is generally a saucer or disk shaped object with a plurality of radially extending fingers 310-313. The basket 300 may be formed in part from a slightly rubbery plastic, such as high density polyethylene plastic or ABS plastic to allow the fingers 310-313 to flex when the basket 300 engages the snow. Each finger 310-313 is separated by a channel, such as channel 314 defined by inwardly angled side walls 316 and 318 and semicircular end wall 320. The semicircular end wall 320 allows the fingers, such as fingers 312 and 313 to flex relative to one another while distributing stress in the basket 300 at the intersection of the side walls 316 and 318 to prevent the basket 300 from cracking between the fingers 312 and 313. Opposite the fingers 310-313, a bottle opener 320 is integrated into the basket 300. The bottle opener 320 is comprised of a metal plate 322 that defines a generally trapezoidally shaped opening 324 sized and shaped to remove a metal bottle cap, such as that found on beer bottles or glass soft drink bottles. The metal plate 322 includes a cap lifting tab 326 proximate an outer edge 328 of the basket 300 configured to grab the bottom edge of a bottle cap and an inwardly curved edge 330 generally parallel to the tab 326 and spaced from the tab 326 so that when the tab 326 engages a bottom edge of the cap, the edge 330 is positioned proximate a middle of the top surface of the cap in order to pry the cap from the top of a bottle. Except for the exposed rim 332 of the bottle opener 320, the metal plate 322 is embedded in the body 334 of the basket 300. In order to allow the fingers 310-313 to flex relative to the central portion 336 of the basket 300, the fingers 310-313 are relatively thin. The portion 338 of the basket 300 that surrounds and encapsulates the metal plate 322 is slightly thicker than the thickness of the fingers 310-313 and the partial disk portion 340 that forms the remainder of the basket 300 between fingers 310 and 313. The partial disk portion 340 houses the portion of the metal plate 322 that forms the bottle opener opening 324. The partial disk portion 340 and the body 334 are thicker around the plate 322 so as to house the plate 322 within the basket 300.

Figure 17:
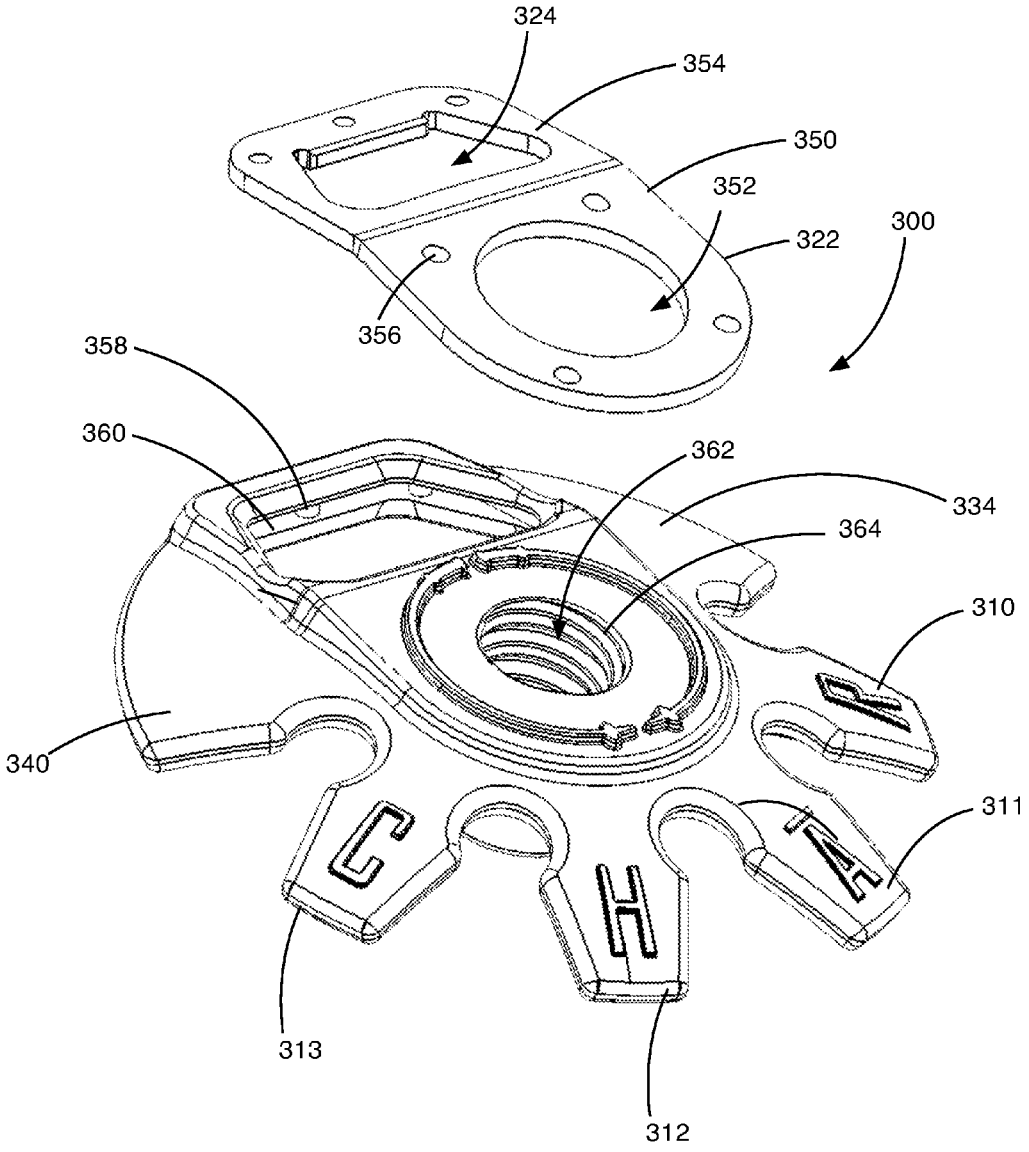
FIG. 17 is an exploded perspective top side view of the ski pole basket illustrated in FIG. 16.

As shown in FIG. 17, which is an exploded view of the basket 300, the basket 300 includes the basket body 334 and the metal plate 322. The metal plate 322 comprises a first portion 350 defining a central aperture 352 that surrounds the pole or tip of the ski pole, depending on the configuration of attachment of the basket 300 to the distal end of the ski pole. A bottle opening portion 354 is integrally formed with first portion and defines the bottle opener opening 324. The bottle opening portion is downwardly angled relative to the first portion 350 to match the downward angle of the fingers 310-313 so that when the plate 322 is formed within the basket body 334 the general frustoconical shape of the basket body 334 is maintained. The plate 322 is provided with a plurality of holes 356 that extend through the plate 322. When the basket 300 is molded, plastic columns 358 are formed through the holes 356 to secure the plate 322 within the space 360 in the body 334, thus fixedly mounting the plate 322 to the body 334 of the basket 300. The plate 322 forms a skeletal structure within the body 334 of the basket 300. By having the first portion 350 of the plate 322 extend around the central aperture 362 of the body 334, the plate 322 provides additional strength to the central aperture 362 when connected to the ski pole or tip with internal threads 364. In addition, by having the first portion 350 extending around the central aperture 362, when a bottle cap is pried from a bottle using the bottle opening portion 354, the bottle opening portion 354 is substantially prevented from upwardly or downwardly flexing relative to the ski pole. As such, a user can simply flip over the ski pole to which the basket 300 is attached and pry a bottle cap from a bottle by grasping the base of the ski pole proximate the basket 300.

Figure 18:
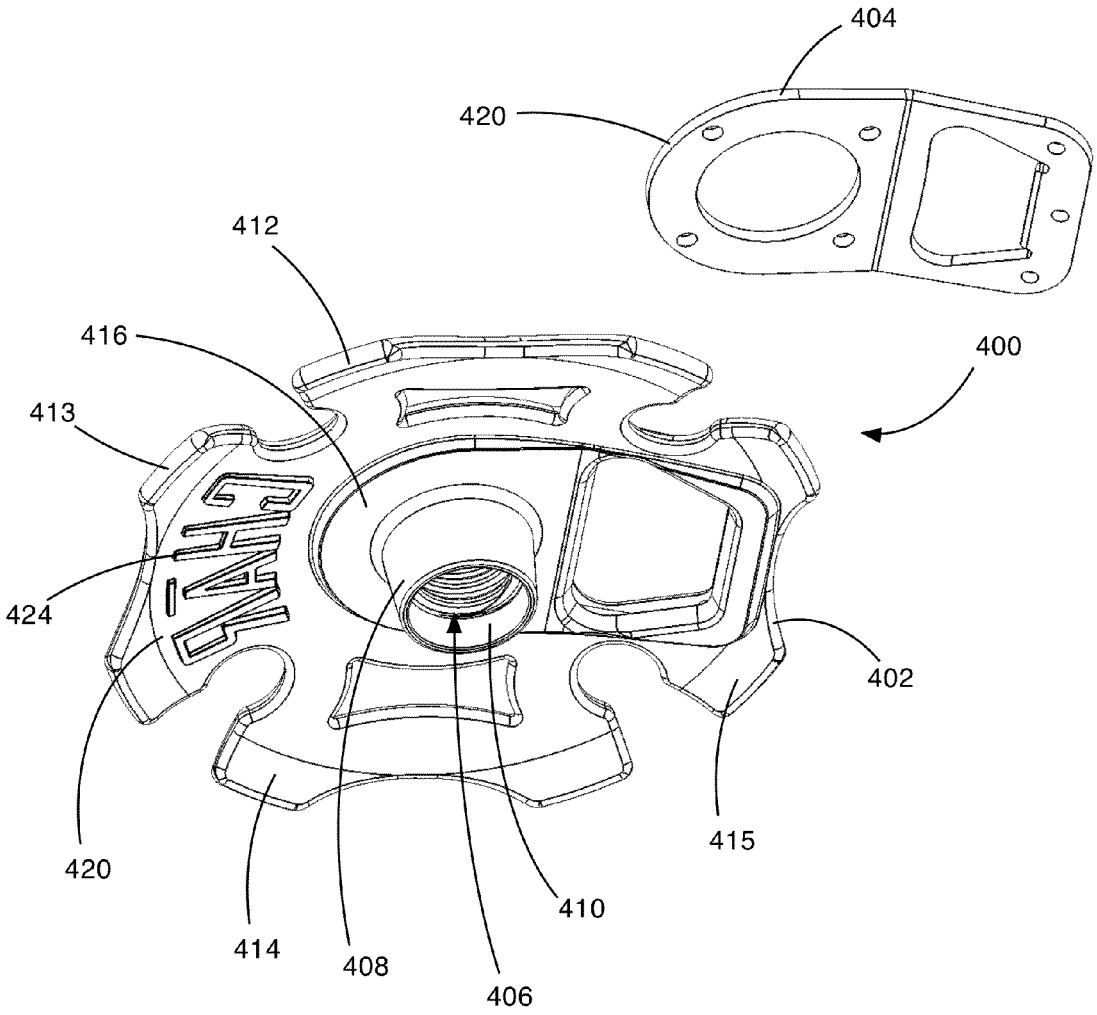
FIG. 18 is a perspective bottom side view of another embodiment of a ski pole basket for a ski pole in accordance with the principles of the present invention.

As shown in FIG. 18, another embodiment of a bottle opener basket, generally indicated at 400, is illustrated in an exploded view. The basket 400, like the basket 300, is comprised of a basket body 402 and bottle opener plate 404. The basket body 402 is configured with a central aperture 406 defined by a pole or tip retaining portion 408 having a generally frustoconical shape and including internal threads 410. The body 402 includes a plurality of radially extending fins 412-415. The fins 412-415 form a snow-flake like pattern. The fin 415 and central portion 416 are configured to house the plate 404 in a similar manner as the plate 322 of FIGS. 16 and 17. The plate 404 also has a similar configuration as the plate 322 of FIG. 17. The basket 400 may be configured for use in powder snow by having a larger contact surface area than the basket 300 of FIG. 16. Each fin 412-414 is independently vertically flexible relative to the other fins. While the fin 415 is substantially rigidly held relative to the center portion 416 of the basket as the attachment portion 420 of the plate 404 extends around the central aperture 406 and is held within the center portion 416. The bottom surface 422 includes a raised marking 424, in the form of a trademark or other desired symbol or image. In this example, the raised marking 424 includes the trademark CHAR in reverse lettering. That is, the marking 424 is a mirror image of the actual mark or image. The raised marking 424 is comprised of a plurality of protrusions that extend from the surface 420. When the basket 400 is pressed against the snow, the marking 424 is imprinted into the snow. When standing in line at a ski lift, for example, the snow is most often packed snow. Pressing the basket 400 against the packed snow by forcibly impacting the snow with the tip of the ski pole until the basket impacts the snow will cause the raised marking to be visibly imprinted into the snow. Other people that move through the ski lift line will see the imprint in the snow and thus know the brand of ski pole or ski basket based on the imprinted image in the snow. Thus, the raised marking on the underside of the ski basket 400 provides an easy means of advertising.

Figure 19:
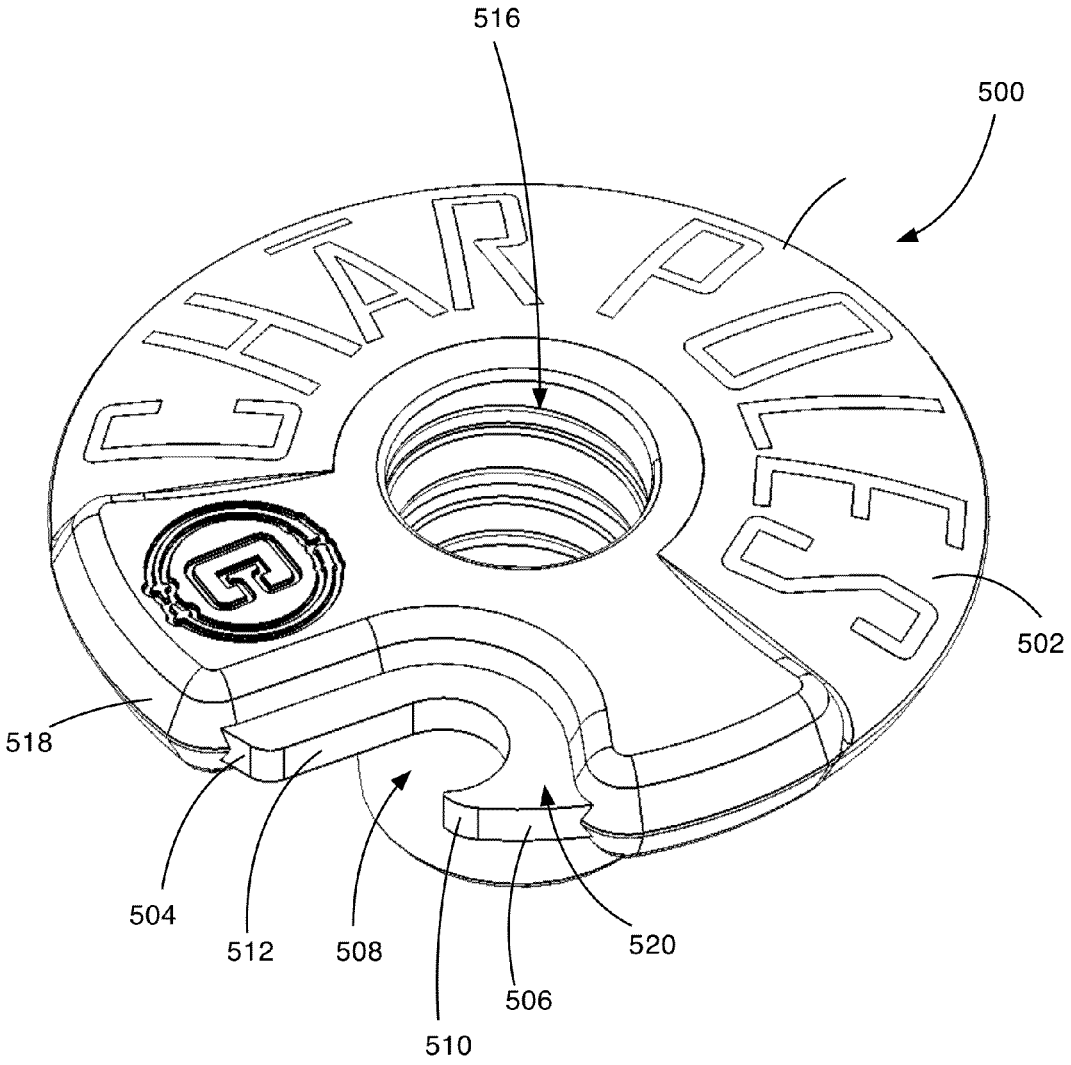
FIG. 19 is a perspective top side view of yet another embodiment of a ski pole basket for a ski pole in accordance with the principles of the present invention.
Figure 20:
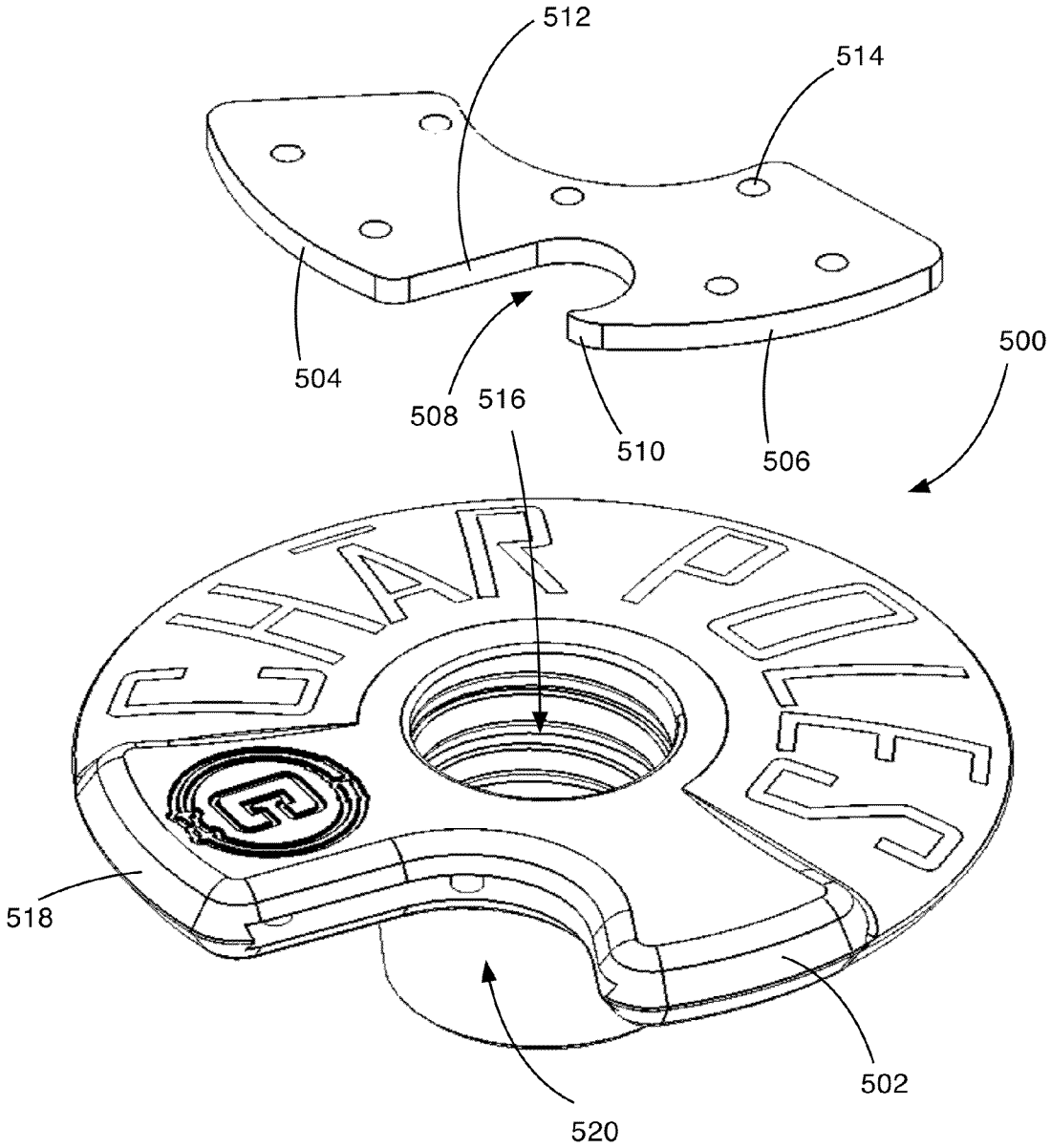
FIG. 20 is an exploded perspective top side view of the ski pole basket illustrated in FIG. 19.

FIGS. 19 and 20 illustrate another embodiment of a bottle opener basket, generally indicated at 500. In this embodiment, the basket 500 is what is generally referred to as a "park" basket and is typically smaller in diameter than the baskets 300 and 400 previously described. The basket 500 has a generally disk shaped body 502 and a bottle opener 504 integrated into the body 502. The bottle opener 504 is comprised of a plate 506 having a J shaped recess 508 formed therein configured for removing a bottle cap from a bottle. The J shaped recess 508 is defined by cap prying portion 510 and an abutting edge 512 for engaging the top of the cap when prying the cap with the prying portion 510. Similar to the plate 322 a plurality of holes 514 are provided to permanently affix the plate 506 within the body 502 of the basket 500. Unlike the opener of FIGS. 16 and 18, the force applied to the basket 500 when using the opener 504 to open a bottle is generally tangential to the body 502 with little vertical force applied to the body 502. As such, the prying causes forces that are generally in plane and thus normal to the central aperture 516 of the body 502. Thus, the plate 506 need not necessarily wrap completely around the aperture 516 in order to be adequately secured to the body 502. Encapsulation of the plate 506 within the thicker housing portion 518 of the body 502 is sufficient to retain the opener 504 within the body 502 of the basket 500. The plate 506 can be formed from stainless steel or other metal materials that are not susceptible to corrosion or rust. In addition, only a portion of the plate 506 surrounding the J shaped recess 508 is exposed with the basket body 502 defining a generally similarly contoured recess 520.

Figure 21:
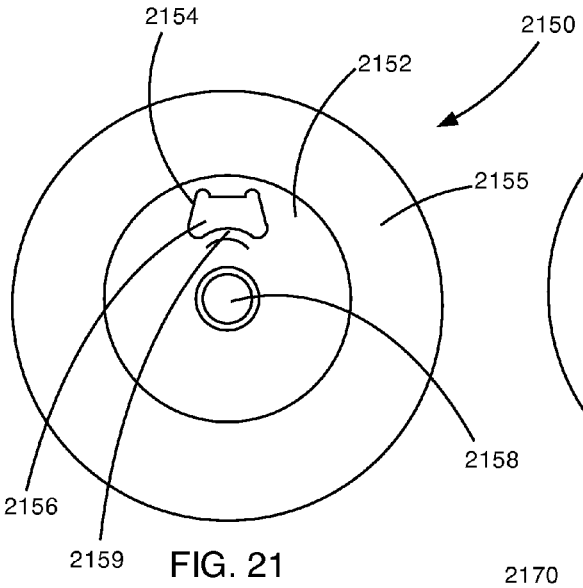
FIGS. 21-25 are additional top side views of other embodiments of ski pole baskets in accordance with the principles of the present invention.
Figure 22:
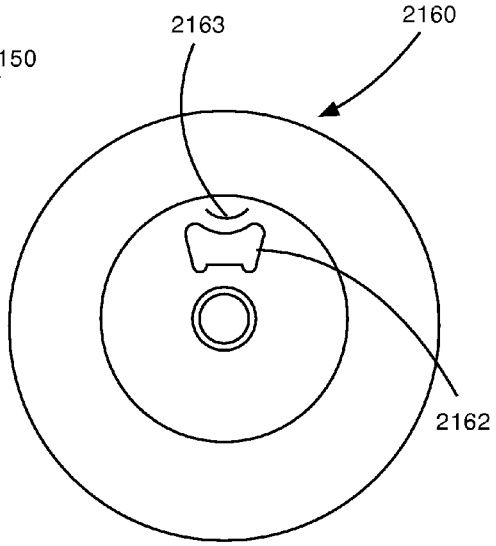
Figure 23:
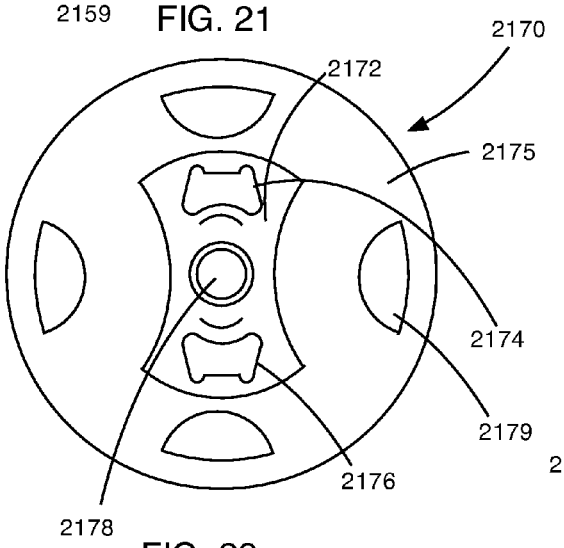
Figure 24:
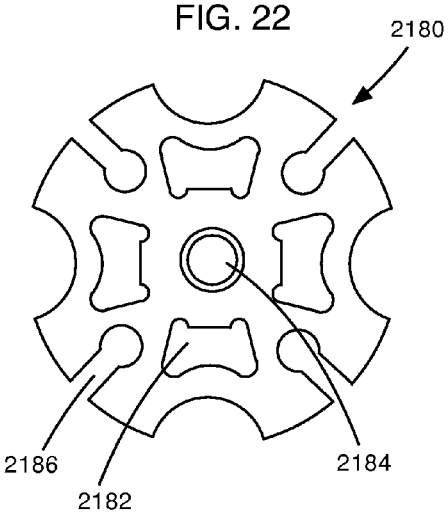

The present invention for a ski pole may also include other uniquely configured basket for attachment to the distal end of the ski pole. As shown in FIGS. 21-24, various other embodiments of a ski pole basket are illustrated, each providing one or more bottle openers incorporated into the basket. As shown in FIG. 21, the ski pole basket 2150 is provided with an inner metal portion 2152 within which a bottle opener 2154, comprising a generally trapezoidally shaped opening 2156 is provided. The basket 2150 is provided with a central aperture 2158 for attachment to a ski pole. The central aperture 2158 may be internally threaded for attachment to the ski pole or may be otherwise configured for fixedly attaching to a ski pole as is known in the art. The metal portion 2152 includes a raised area 2159 adjacent the opener 2154 for abutting against the bottle cap to be opened by the opener 2154. The metal portion 2152 is surrounded by a plastic portion 2155 that forms the remaining portion of the basket 2150. The basket 2160 illustrated in FIG. 22 is similar in configuration to the basket 2150 shown in FIG. 21 with a bottle opener 2162 and raised portion 2163 oriented in an opposite direction. As shown in FIG. 23, the central metal portion or metal skeleton 2172 is elongated with two bottle openers 2174 and 2176 formed therein on opposite sides of the central aperture 2178 of the basket 2170. Other apertures 2179 may be formed in the plastic part 2175 of the basket 2170 to decrease weight of the basket 2170 and to add design elements to the basket 2170. The basket 2180 shown in FIG. 24 is configured with four bottle openers 2182 of similar configuration radially oriented around the central aperture 2184 of the basket. Other channels, recesses, apertures or openings, such as opening 2186, are provided to improve the performance the basket and to allow flex of the basket when impacting the snow.

Figure 25:
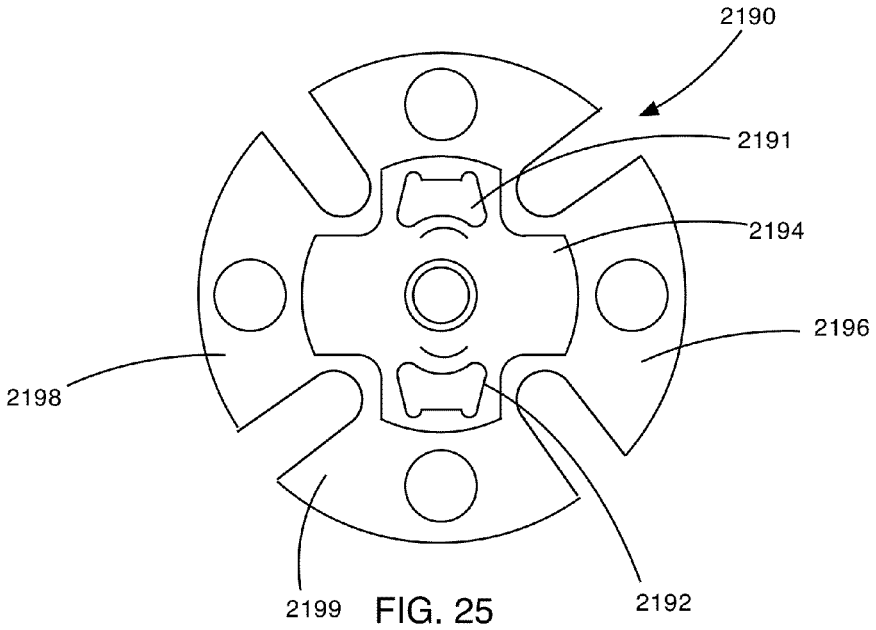

FIG. 25 illustrates yet another embodiment of a basket 2190 with a pair of bottle openers 2191 and 2192 provided in a generally cross-shaped metal skeleton 2194. The metal skeleton is embedded in a plastic basket component 2196 that surrounds the skeleton 2194 and is fixedly secured thereto as by having the plastic basket component molded around the metal skeleton 2194. The plastic basket component 2196 may be provided with various openings and channels to increase the performance characteristics of the basket in snow and to allow some flex of the plastic basket component of each radially extending portion 2198 separate from other radially extending portions 2199.

Figure 26A:
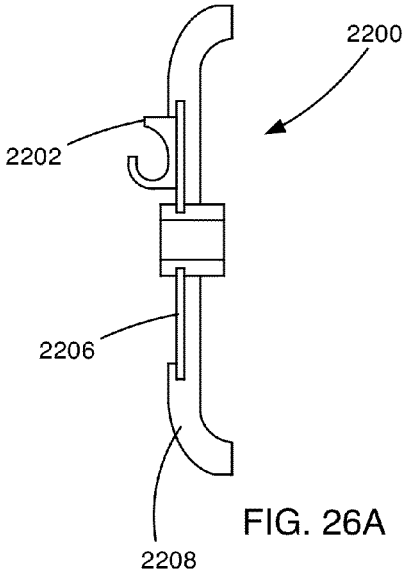
FIGS. 26A and 26B are cross-sectional side side and top side views, respectively of yet another embodiment of a ski pole basket in accordance with the principles of the present invention.
Figure 26B:
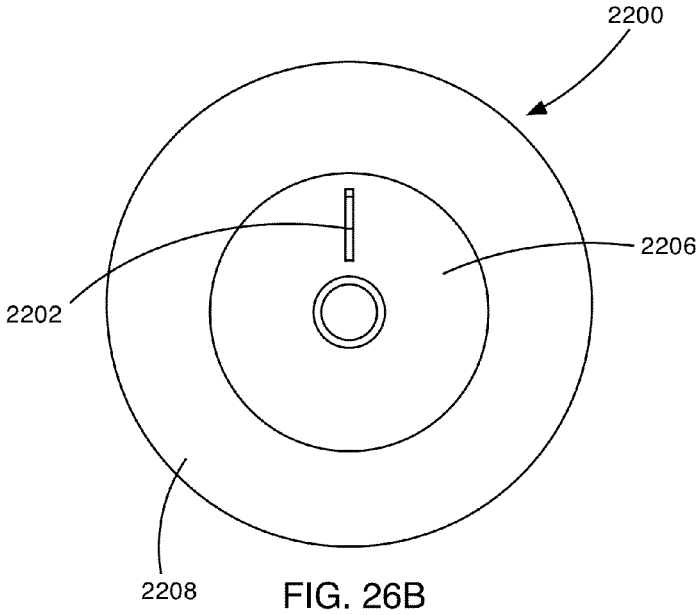

As shown in FIGS. 26A and 26B, a basket 2200 according to the present invention may include a vertically oriented bottle opener 2202 comprised of a hook-shaped member fixedly attached to a central portion 2206 of the basket 2200. The central portion 2206 may be comprised of metal along with the bottle opener to prevent the bottle opener from substantially flexing during use. The remaining circular portion 2208 of the basket 2200 may be comprised of plastic to decrease the weight of the basket and to allow the basket to flex to some degree during use.

Figure 27:
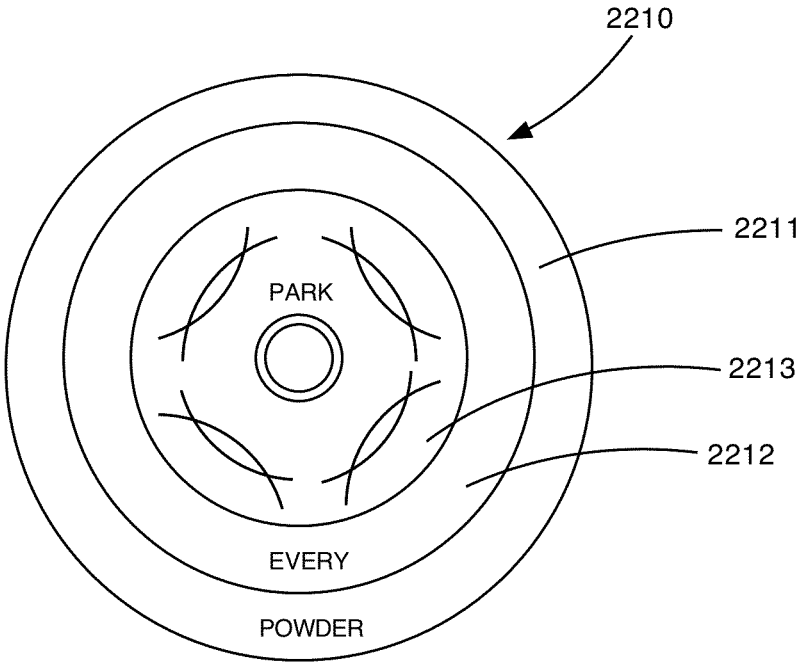
FIGS. 27 and 28 are additional top side views of other embodiments of ski pole baskets in accordance with the principles of the present invention.

In one embodiment, as shown in FIG. 27, a basket 2210 is comprised of a three part basket with the outer two 2211 and 2212 parts being individually and selectively removable from the central basket part 2213. The basket parts 2211-2213 are each provided for different snow conditions, the outermost ring 2211 being provided for powder conditions where the surface area of the basket is to be the greatest, a middle ring 2212 being provided for situations where the skier may encounter various conditions from packed snow to some powder and a central ring 2213 where the conditions are set for racing or other hard packed conditions.

Figure 28:
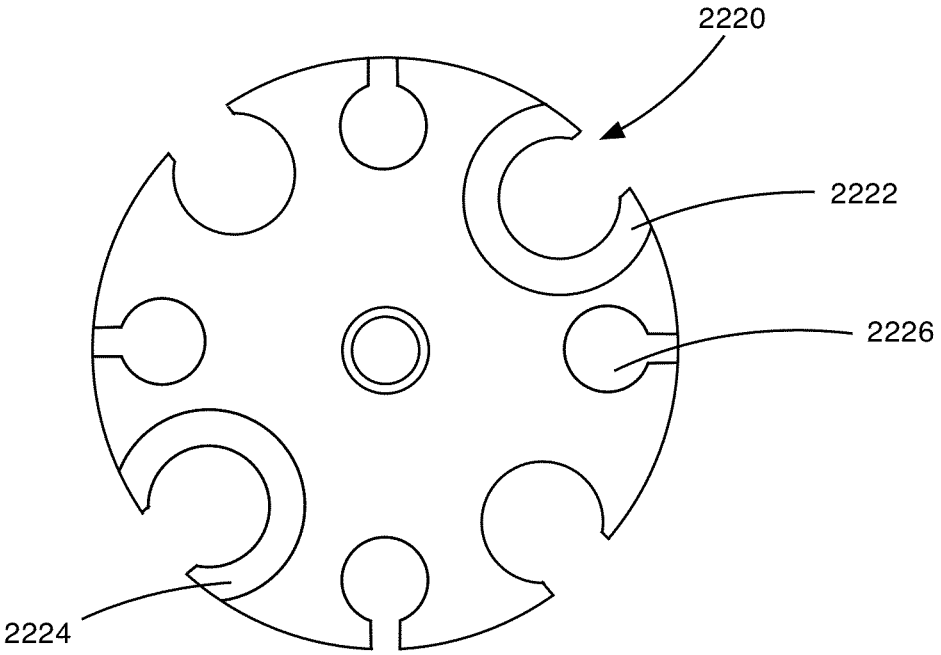

In yet another embodiment shown in FIG. 28, a basket 2220 is provided with bottle openers in the form of C-shaped metal members 2222 and 2224 formed into the perimeter of the basket 2220. Other apertures 2226 may be provided to add flexibility to the basket 2220. The openers 2222 and 2224 may be used to engage a bottle cap to remove it from a bottle.

Figure 29:
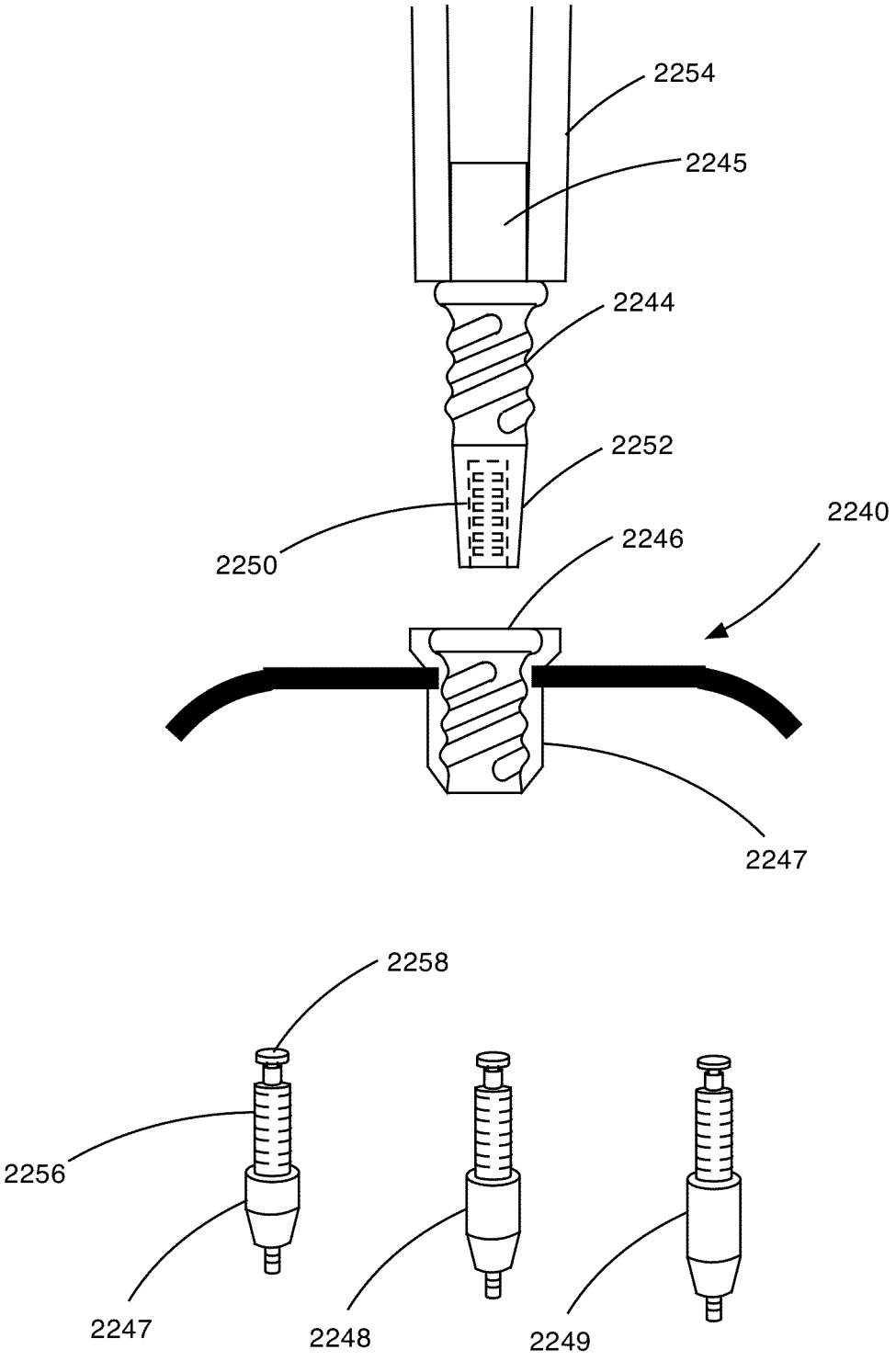
FIG. 29 is a side view of various ski pole tips for use with a ski pole in accordance with the principles of the present invention.

As shown in FIG. 29, a basket 2240 according to the present invention may be attached to a distal end of a pole 2254 with a threaded fitting 2244 coupled to the distal end of the pole 2254 and with the basket 2240 having an internally threaded central aperture 2246 in the central portion 2247 configured for mating with the threaded fitting 2244. The fitting 2244 has an upper plug portion 2245 that is mated to the pole 2254. Various tip components 2247-2249 can be inserted into a mating aperture 2250 in the distal end 2252 of the ski pole 2254. Each tip 2247-2249 is provided for various ski conditions, with shorter tips 2247 provided for hard pack snow conditions and longer tips 2249 provided for powder conditions. Each tip is provided with a threaded portion 2256 and an upper locking portion 2258 for threaded engagement with the aperture 2250 and for locking the tip to the aperture 2250 with the locking portion 2258.

Figure 30:
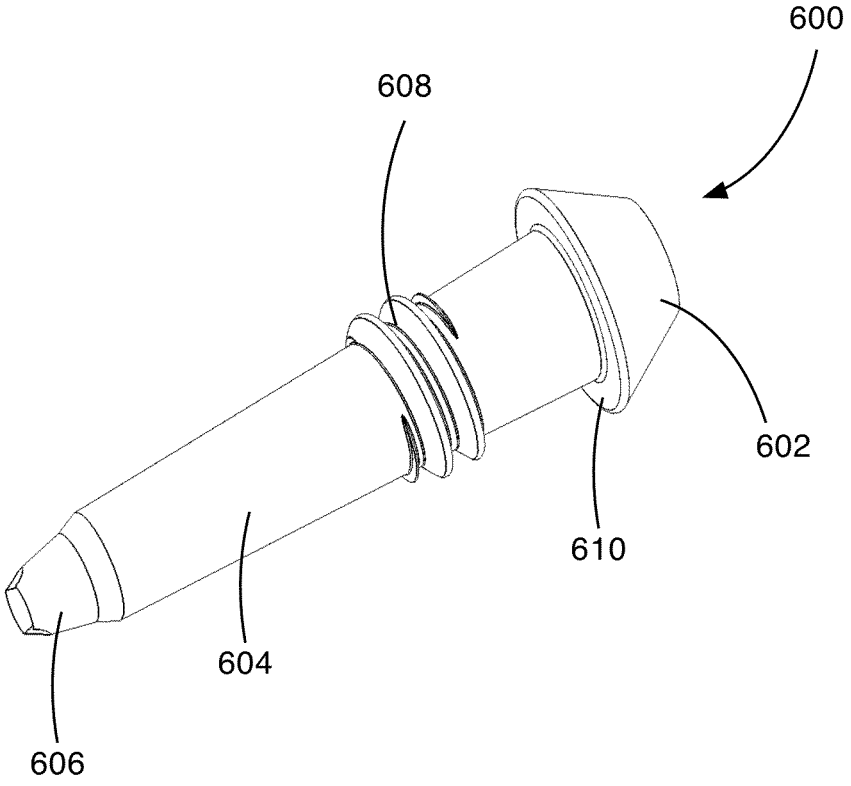
FIG. 30 is a perspective side view of another embodiment of a ski pole tip for use with a ski pole in accordance with the principles of the present invention.

FIG. 30 illustrates another embodiment of a tip 600 in accordance with the principles of the present invention configured for attachment to a distal end of a ski pole. The tip 600 includes a head portion 602 into which the pole is inserted and attached. The tip 600 also includes a shaft portion 604 within includes a metal tip 606 embedded in the distal end of the shaft portion 604. A portion of the shaft 604 includes external threads 608 for threadedly engaging with threads in a basket, as previously shown and described. The head 602 forms an abutting surface 610 for abutting against a top surface of the basket when the basket is threaded onto the tip. The tip 600 thus attaches the basket to the ski pole and also provides a metal tip 606 for preventing excessive wear of the tip 604 which may otherwise be formed from plastic.

In the foregoing specification, the present invention has been described with reference to specific exemplary embodiments. Various modifications and changes may be made, however, without departing from the spirit and scope of the present invention as set forth in the claims. The specification and figures are illustrative, not restrictive, and modifications are intended to be included within the scope of the present invention. Accordingly, the scope of the present invention should be determined by the claims and their legal equivalents rather than by merely the examples described.

For example, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

What is claimed is:

1. A ski pole, comprising:

an elongate pole having a distal end and a proximal end;

a grip attached to the proximal end of the elongate pole configured for grasping by a user, the grip having a proximal end and a distal end and defining a longitudinally extending bore therebetween configured for receiving the proximal end of the elongate pole in a distal end of the grip;

a tool assembly releasably coupled to the proximal end of the grip and housed at least partially within the grip, the tool assembly comprising a head portion defining a recess in an upper surface thereof, a neck portion extending from the head portion and a tool attached to the neck and extending into the grip; and a camera mount comprising a threaded post configured for mounting a camera, the camera mount being pivotally coupled to a top of the head portion and pivotable between a first position and a second open position, the threaded post positioned within the recess when in the camera mount is in the first position and exposed and having a longitudinal axis that is substantially parallel to a long axis of the elongate pole when the camera mount is in the second position.

2. The ski pole of claim 1, wherein the camera mount comprises a "d" shaped body comprising a rounded pivotable portion configured for mounting within the recess of the head portion and a laterally extending portion having a top surface to which the threaded post is attached.

3. The ski pole of claim 2, wherein the pin defines a pivot axis offset from and perpendicular to the threaded post allowing the threaded post to pivot from the first position that is near the long axis of the elongate pole to a second position that is nearer a perimeter of the head.

4. The ski pole of claim 3, wherein a proximal end of the camera mount opposite the rounded portion is spaced from the pivot axis so as to be proximate the perimeter of the head when the camera mount is in the first position.

5. The ski pole of claim 4, wherein the proximal end of the camera mount is configured to be engageable by a user to allow the user to pivot the camera mount from the first position to the second position.

6. The ski pole of claim 1, further comprising at least one protrusion formed on the outside of the camera mount proximate the proximal end and at least two indentations formed in the head portion within the recess for retaining the camera mount relative to the head portion when the at least one protrusion engages at least one of the at least two indentations in either the first or second positions.

7. The ski pole of claim 1, wherein the longitudinally extending bore of the grip includes internal threads in a proximal end thereof and the neck portion of the tool assembly includes external threads for releasably coupling the tool assembly to the grip.

8. The ski pole of claim 1, further comprising first and second strap attachment members, the first strap attachment member coupled to the proximal end of the grip and retained by the tool assembly and the second strap attachment member coupled to the distal end of the grip.

9. The ski pole of claim 8, wherein the first strap attachment member comprises a ring portion and a strap attachment portion integrally formed with the ring portion and wherein the head portion of the tool assembly has an outer diameter that is greater than an inner diameter of the ring portion of the first strap attachment member to retain the first strap attachment member to the grip.

10. The ski pole of claim 1, further comprising a threaded insert attached to the grip and positioned within the longitudinally extending bore of the grip, the threaded insert configured for threadedly mating with the proximal end of the pole.

11. The ski pole of claim 10, wherein the tool extends through the threaded insert and into the elongate pole when the head portion of the tool assembly is coupled to the proximal end of the grip.

12. The ski pole of claim 1, wherein the recess comprises a first surface for abutting a top surface of the camera mount when in the second position, a lower recess portion adjacent the first surface configured for receiving a rounded portion of the camera mount and a camera post receiving portion proximate a proximal end of the recess configured for receiving the threaded post when the camera mount is in the first position.

13. A grip for a ski pole, comprising:

an elongate body having proximal end and a distal end and defining a longitudinally extending bore therein between configured for receiving a proximal end of a ski pole through a distal end of the elongate body;

a tool assembly releasably coupled to the proximal end of the elongate body and at least partially housed within the elongate body, the tool assembly comprising a head defining a recess in a proximal end of the head; and a camera mount pivotally coupled to the head and pivotable between a first position and a second position, the camera mount at least partially positioned within the recess and wherein the camera mount comprises a post configured for mounting a camera and having a long axis that extends substantially parallel to a long axis of the ski pole when the camera mount is in the first position.

14. The grip of claim 13, wherein the camera mount comprises a "d" shaped body comprising a rounded pivotable portion configured for mounting within the recess of the head and a laterally extending portion having a top surface to which a threaded post is attached.

15. The grip of claim 14, further comprising a laterally extending pin transversely extending through the rounded pivotable portion and coupling the camera mount to the head so that the camera mount can pivot about the pin relative to the head, the pin defining a pivot axis offset from and perpendicular to the threaded post allowing the threaded post to pivot from the first position that is near the long axis of the elongate pole to a second position that is nearer a perimeter of the head.

16. The grip of claim 15, wherein a proximal end of the camera mount opposite the rounded portion is spaced from the pivot axis so as to be proximate the perimeter of the head when the camera mount is in the first position.

17. The grip of claim 16, wherein the proximal end of the camera mount is configured to be engageable by a user to allow the user to pivot the camera mount from the first position to the second position.

18. The grip of claim 13, further comprising first and second strap attachment members, the first strap attachment member coupled to the proximal end of the elongate body and retained by the head and the second strap attachment member coupled to the distal end of the elongate body.

19. The grip of claim 18, wherein the first strap attachment member comprises a ring portion and a strap attachment portion integrally formed with the ring portion and wherein the head has an outer diameter that is greater than an inner diameter of the ring portion of the first strap attachment member to retain the first strap attachment member to the elongate body.

20. The grip of claim 13, wherein the tool assembly comprises a screwdriver extending from a distal end of the head and through the longitudinally extending bore of the elongate body.

21. The grip of claim 13, further comprising an insert attached to the elongate body and positioned within the longitudinally extending bore of the elongate body, the insert configured for mating with and securing a proximal end of a ski pole to the elongate body.

22. The grip of claim 13, further comprising at least one protrusion formed on the outside of the camera mount proximate the proximate end and at least two indentations formed in the head within the recess for retaining the camera mount relative to the head when the at least one protrusion engages at least one of the at least two indentations in either the first or second positions.

23. The grip of claim 13, wherein the recess comprises a first surface for abutting a top surface of the camera mount when in the second position, a lower recess portion adjacent the first surface configured for receiving a rounded portion of the camera mount and a camera post receiving portion proximate a proximal end of the recess configured for receiving the threaded post when the camera mount is in the first position.

* * * * *